US009748083B2

(12) United States Patent
Makarov

(10) Patent No.: US 9,748,083 B2
(45) Date of Patent: Aug. 29, 2017

(54) METHOD OF TANDEM MASS SPECTROMETRY

(71) Applicant: Thermo Fisher Scientific (Bremen) GmbH, Bremen (DE)

(72) Inventor: Alexander Alekseevich Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/367,857

(22) PCT Filed: Dec. 24, 2012

(86) PCT No.: PCT/EP2012/076874
§ 371 (c)(1),
(2) Date: Jun. 20, 2014

(87) PCT Pub. No.: WO2013/093114
PCT Pub. Date: Jun. 27, 2013

(65) Prior Publication Data

US 2014/0346345 A1 Nov. 27, 2014

(30) Foreign Application Priority Data

Dec. 22, 2011 (GB) ..... 1122178.5

(51) Int. Cl.
*H01J 49/00* (2006.01)
*H01J 49/06* (2006.01)

(52) U.S. Cl.
CPC ..... *H01J 49/0045* (2013.01); *H01J 49/004* (2013.01); *H01J 49/0031* (2013.01); *H01J 49/06* (2013.01)

(58) Field of Classification Search
USPC ..... 250/283
See application file for complete search history.

(56) References Cited

U.S. PATENT DOCUMENTS 5,572,035 A 11/1996 Franzen
5,783,824 A 7/1998 Baba et al.
(Continued)

FOREIGN PATENT DOCUMENTS

EP 1505632 A1 2/2005
EP 1505635 A2 2/2005
(Continued)

OTHER PUBLICATIONS

Bollen, G., ""Ion surfing" with radiofrequency carpets," International Journal of Mass Spectrometry 299 (2011), pp. 131-138.
(Continued)

*Primary Examiner* — Phillip A Johnston
(74) *Attorney, Agent, or Firm* — David A. Schell; Charles B. Katz

(57) ABSTRACT

A method of tandem mass spectrometry is disclosed. A quasi-continuous stream of ions from an ion source (20) and having a relatively broad range of mass to charge ratio ions is segmented temporally into a plurality of segments. Each segment is subjected to an independently selected degree of fragmentation, so that, for example, some segments of the broad mass range are fragmented while others are not. The resultant ion population, containing both precursor and fragment ions, is analyzed in a single acquisition cycle using a high resolution mass analyzer (150). The technique allows the analysis of the initial ion population to be optimized for analytical limitations.

29 Claims, 12 Drawing Sheets

(56) References Cited

U.S. PATENT DOCUMENTS

| | | | | |
|---|---|---|---|---|
| 5,847,386 | A | 12/1998 | Thomson et al. | |
| 6,107,623 | A * | 8/2000 | Bateman | H01J 49/004 250/282 |
| 6,177,668 | B1 | 1/2001 | Hager | |
| 6,300,626 | B1 | 10/2001 | Brock et al. | |
| 6,483,109 | B1 | 11/2002 | Reinhold et al. | |
| 6,498,342 | B1 | 12/2002 | Clemmer | |
| 6,586,727 | B2 * | 7/2003 | Bateman | H01J 49/0045 250/281 |
| 6,713,757 | B2 | 3/2004 | Tanner et al. | |
| 6,794,642 | B2 | 9/2004 | Bateman et al. | |
| 6,875,980 | B2 | 4/2005 | Bateman et al. | |
| 6,987,264 | B1 | 1/2006 | Whitehouse et al. | |
| 7,019,289 | B2 | 3/2006 | Wang | |
| 7,034,292 | B1 | 4/2006 | Whitehouse et al. | |
| 7,049,584 | B1 | 5/2006 | Whitehouse et al. | |
| 7,067,802 | B1 | 6/2006 | Kovtoun | |
| 7,071,464 | B2 | 7/2006 | Reinhold | |
| 7,157,698 | B2 | 1/2007 | Makarov et al. | |
| 7,238,531 | B2 * | 7/2007 | Chace | C12Q 1/32 436/173 |
| 7,385,187 | B2 | 6/2008 | Verentchikov et al. | |
| 7,446,310 | B2 * | 11/2008 | Kovtoun | H01J 49/004 250/281 |
| 7,482,581 | B2 * | 1/2009 | Lange | H01J 49/0031 250/281 |
| 7,514,673 | B2 | 4/2009 | Senko et al. | |
| 7,541,575 | B2 * | 6/2009 | Lock | H01J 49/005 250/281 |
| 7,560,688 | B2 | 7/2009 | Clowers et al. | |
| 7,582,864 | B2 | 9/2009 | Verentchikov | |
| 7,718,959 | B2 | 5/2010 | Franzen et al. | |
| 7,781,728 | B2 | 8/2010 | Senko et al. | |
| 7,847,246 | B2 * | 12/2010 | Brekenfeld | H01J 49/005 250/281 |
| 7,858,926 | B1 | 12/2010 | Whitehouse et al. | |
| 7,923,681 | B2 | 4/2011 | Collings et al. | |
| 8,101,910 | B2 | 1/2012 | Loboda | |
| 8,278,619 | B2 | 10/2012 | Makarov et al. | |
| 8,334,507 | B1 | 12/2012 | Whitehouse et al. | |
| 8,481,924 | B2 * | 7/2013 | Savitski | H01J 49/0045 250/281 |
| 2004/0183007 | A1 | 9/2004 | Belov et al. | |
| 2008/0048109 | A1 | 2/2008 | Schwartz et al. | |
| 2008/0067349 | A1 | 3/2008 | Moskovets et al. | |
| 2008/0087814 | A1 | 4/2008 | Loucks | |
| 2008/0173807 | A1 | 7/2008 | Yoon et al. | |
| 2008/0224033 | A1 | 9/2008 | Makarov | |
| 2009/0206248 | A1 | 8/2009 | Makarov et al. | |
| 2009/0294644 | A1 | 12/2009 | Belov | |
| 2011/0240851 | A1 | 10/2011 | Okumura et al. | |
| 2011/0266426 | A1 | 11/2011 | Schwartz et al. | |

FOREIGN PATENT DOCUMENTS

| | | | |
|---|---|---|---|
| GB | 2363249 | B | 8/2002 |
| GB | 2432712 | B | 12/2007 |
| GB | 2441198 | A | 2/2008 |
| GB | 2438488 | B | 10/2008 |
| GB | 2451962 | B | 2/2010 |
| WO | WO9214259 | A1 | 8/1992 |
| WO | 2007/060421 | A2 | 5/2007 |
| WO | WO2010120496 | A1 | 10/2010 |
| WO | WO2012141878 | A2 | 10/2012 |

OTHER PUBLICATIONS

Schwarz, S., "RF ion carpets: The electric field, the effective potential, operational parameters and an analysis of stability," International Journal of Mass Spectrometry 299 (2011), pp. 71-77.

* cited by examiner

METHOD OF TANDEM MASS SPECTROMETRY

FIELD OF THE INVENTION

This invention relates to the field of tandem mass spectrometry.

BACKGROUND OF THE INVENTION

Various techniques have been developed for the targeted and untargeted analysis of complex mixtures using tandem mass spectrometry (MS).

The traditional approach for untargeted analysis (that is, analysis without prior knowledge) of an analyte is to carry out a data dependent selection of a suitable precursor ion of a particular mass to charge ratio (m/z). For example, the, or one of the, more intense peaks in the mass spectrum, which has not yet been analysed, can be selected. That suitable precursor can then be fragmented and the fragments detected in an MS/MS analysis technique.

Selection/isolation of the suitable precursor ion is typically achieved by a quadrupole mass filter or linear trap analyzer. Fragmentation of the selected precursor may be achieved, typically, through collision of the precursor ion with gas or ion-ion or ion-molecule reactions. The detection of the resulting fragments may be achieved through a scanning quadrupole filter or, in preference, by using an all-ion analyzer such as a time of flight (TOF), Orbitrap™ or Fourier Transform Ion Cyclotron Resonance (FTICR) analyzer.

A drawback of the above arrangement is that only a restricted number of available precursors will generate a corresponding MS/MS spectrum, as a result of limitations on transmission and the complexity of mixtures. In consequence, the depth of analysis of complex mixtures such as are found in proteomics, environmental, food, drug metabolism and other applications is severely curtailed.

An alternative to this traditional approach employs MS/MS but splits the ion beam from the ion source into packets according to their mass to charge ratio. A particular packet or packets is/are fragmented without loss of others of the packets, or alternatively, in parallel with other of the packets. This splitting into packets may be performed using a scanning device which stores ions of a broad mass range, such as a 3D ion trap as is disclosed, for example, in WO-A-03/103,010, or a linear trap with radial ejection as is disclosed in, for example, U.S. Pat. No. 7,157,698. Alternatively, packet splitting may be achieved using pulsed ion mobility spectrometry, and some suitable apparatuses and techniques are described in WO-A-00/70335 and US-A-2003/0,213,900 respectively. Still further alternatives involve slowed down linear mass spectrometers, see for example WO-A-2004/085,992, or multi reflection time of flight mass spectrometers as in WO-A-2004/008,481.

In all of the above cases, the first stage of mass analysis is followed by fast fragmentation, for example in a collision cell (preferably with an axial gradient), or using a pulsed laser. The fragments are then analysed, again in preference using another TOF mass spectrometer on a much faster timescale than the scanning duration (the fast analysis times are referred to in the art as "nested times"). The overall performance is, however, compromised because only a very limited time is allocated to each scan (typically, no more than 10-20 microseconds).

These approaches of so called "two dimensional MS" apparently provide improved throughput without compromising sensitivity. In this respect they are superior to a variant of traditional MS/MS, expanded to a multi channel configuration in which a number of parallel mass analyzers (typically ion traps) are used to select one precursor each, and then its fragments are scanned out to an individual associated detector (eg the ion trap array of U.S. Pat. No. 5,206,506 or multiple traps of US-A-2003/089,846).

Even so, all 2D-MS techniques currently representing the state of the art suffer from relatively low resolution of precursor selection (typically, no better than one to several atomic mass units, a.m.u.). They also tend to suffer from relatively low resolving power of fragment analysis—typically no better than a few hundred to a few thousand (and thus provide poor mass accuracy). Furthermore, the known 2D-MS techniques are each based on the use of trapping devices to provide a high duty cycle. Such devices have an overall cycle time which is defined by the cycle time of the slowest analyzer in the system. Modern ion sources produce ion current up to 100 s of pA, that is, in excess of $10^9$ elementary charges per second. Thus, if the full cycle of scanning through the entire mass range of interest is 5 milliseconds, then such trapping devices need to be able to accumulate up to 5 million elementary charges yet still allow efficient precursor selection. These difficulties have precluded such approaches from entering main stream, practical mass spectrometry.

As a compromise, therefore, an alternative method has been developed on the basis of the time of flight (TOF) analyzer, and is available on the market under the name $MS^e$. In this approach, precursor ions are caused to pass through a fragmentation or reaction device alternately at higher and lower energy, resulting in the formation of product ions in the former case (see, for example, U.S. Pat. No. 6,586,727 and U.S. Pat. No. 6,982,414). This can readily be accomplished using a Q-TOF type instrument, by operating the quadrupole mass filter in the RF-only mode such as the simultaneously transmit approximately a decade in mass into the gas collision cell with higher collision energy, sufficient to induce fragmentation. The technique is set out in for example Bateman et al., J Am Soc Mass Spectrom. 2002, 13, pages 792-803. The orthogonal time of flight mass spectrometer records the mass spectrum of the resulting mixture of precursor and fragment ions. It is not necessary to remove the gas from the collision cell. Hence, by alternating the collision energy (typically, from less than 10V to between 30 and 70V), it is possible to alternate between recording the spectrum exhibiting mainly precursor ions, and the spectrum exhibiting the mixture of precursor ions and their fragment ions.

In an alternative method to alternating the collision energy, ions may be directed into the fragmentation cell at an appropriate energy such that significant fragmentation occurs and from there to analysis. As a further alternative, ions may be allowed to enter the analyzer directly along a different path where significant fragmentation does not occur. Such a method is described in U.S. Pat. No. 7,759,638.

In the first mode, wherein relatively low collision energy is employed, no—or substantially no—fragmentation of ions takes place so that precursor ions will be relatively more intense in the resultant mass spectrum. In the second mode, wherein a relatively higher collision energy is employed, most or indeed all of the precursor ions are fragmented so that the fragment ions are relatively more intense in the resultant mass spectrum in this second mode. Hence, by suitable adjustment of the collision energy in the two operating modes, precursor and product ions may be readily distinguished. The method may be further enhanced by utilising the chromatographic separation of analytes which introduces a temporal dimension as well. That is, the method may utilise the dependence of ion current on retention time. From this, it is possible to group elution profiles of various fragment ions, with those of precursors, and thus in turn it is possible to separate one family of precursor ions, with its fragments, from another family of precursor ions. Furthermore, the use of high resolution/accurate mass analyzers makes such a grouping much more reliable.

Nevertheless, the $MS^e$ approach proposed by Bateman and others suffers from a number of limitations. Firstly, the extremely large number of precursors, and the range of their concentrations, in modern mass spectrometric analysis, limits the applicability of this method to the most intense peaks only: spectra become very crowded at lower intensities upon fragmentation. Secondly, there is no way to distinguish co-eluting peaks, which results in an increased number of false identifications, for complex mixtures. Thirdly, in consequence of the above, the method does not work for infusion, when no chromatographic peaks are formed. Fourthly, the high-energy fragmentation spectra typically exhibit many more peaks than the low-energy (non-fragmentation) spectra and can suffer from overcrowding of the spectra. The latter is especially pronounced when analyzing a single class of analytes such as peptides, which are all built from common aminoacids.

WO-A-2010/120496 describes an arrangement in which a multiple fill Higher Collision Energy Dissociation (HCD) cell functionality, or a C-trap cell functionality of an accurate-mass mass analyzer system is employed to avoid performing a separate full scan MS event. Instead a scan event is substituted which detects all ions originating from high and low collision energy fills simultaneously. This simultaneous analysis technique allows execution of all ion $MS^2$ experiments significantly faster than when discrete spectra are acquired at specified collision energy. However, this method may still yield spectra that are more crowded that is desirable.

SUMMARY OF THE INVENTION

It is an aim of the present invention to address at least some of the foregoing problems with the prior art.

In accordance with the first aspect of the present invention there is provided a method of tandem mass spectrometry in accordance with claim 1.

The method of the present invention thus addresses limitations with the prior art by providing for segmentation of a relatively broad range of mass to charge ratio ions, arriving typically as a quasi-continuous stream of ions from the ion source, into a plurality of segments. Each segment is subjected to an independently selected degree of fragmentation. In the simplest embodiments, each segment is fragmented, or not fragmented, so that the total ion population across the relatively broad range making up the various segments contains both fragmented and unfragmented segments. The resultant population can be mass analysed using a high resolution mass analyzer, either as a mixture or separately with the separate spectra being stitched together.

Sub-dividing the relatively broader mass range into a plurality of relatively narrower segments permits the ion population which is a combination or mixture of each of the resulting precursors and fragments to be tuned or optimised in respect of the limitations of analysis. For example, by appropriate segmentation of a broad mass range, it is possible to "weight" the precursor ions which have relatively higher m/z relative to the precursors that have smaller m/z so as to compensate for over fragmentation in the case of the smaller m/z and/or higher z, and equally to compensate for under fragmentation in respect of ions of higher m/z. Equally, it is possible to compensate for the fact that high energy (fragmentation) spectra typically exhibit significantly more peaks than low energy spectra with no fragmentation since, of course, a single precursor will usually produce multiple fragments. Where only some of the segments are fragmented, the total number of fragment ions in the total ion population is reduced, since, in respect of at least some of the segments, no fragmentation takes place. Thus, possible overcrowding of peaks in the spectra is reduced compared to the known $MS^e$ technique in which ions across the total mass range are fragmented in one spectrum.

In preference, segmentation of the relatively broader mass range is data dependent. For example, a pre-scan may be carried out in order to obtain preliminary data regarding the contents of the relatively broad mass range to be investigated. This pre-scan can then be employed to determine the relative width of each segment (which need not be the same as other segments), in terms of the range of mass to charge ratios within each segment. Other parameters can also be adjusted in order to specify a particular number of ions to be transmitted in respect of each segment. Separately, the fragmentation mode can be selected for each segment—that is, whether fragmentation is to take place or not. Whilst, in a preferred embodiment, a first, relatively low fragmentation energy results in substantially no precursor ions being fragmented, whilst when a second, relatively high fragmentation energy is applied, substantially total fragmentation takes place, other, partial fragmentation schemes can be employed in respect of some of the segments as well/instead. In any case, the degree of fragmentation when the relatively higher fragmentation energy is applied is greater than when the relatively lower fragmentation energy is applied. Adjustment of the fragmentation energy in this way can select the fragmentation mode in embodiments utilising collisional fragmentation. However, in other embodiments, other fragmentation techniques may be used, such as electron transfer dissociation (ETD), electron capture dissociation (ECD); electron ionisation dissociation (EID); ozone induced dissociation (OzID), Infrared multiphoton dissociation (IRMPD) or UV dissociation. In those embodiments, the fragmentation mode can be selected for each segment by means other than adjusting the fragmentation energy, such as by adjusting an electron, photon, ion, or reactant flux into the fragmentation cell, or interaction time, optionally in combination with adjusting the voltage of the fragmentation cell.

In further particularly preferred embodiments, multiple cycles or scans of a particular relatively broad mass range can be carried out, in each case using, for example, different fragmentation schemes for the different segments, different segmentation strategies, and so forth. The results of the multiple different segmentation and fragmentation schemes can be compared against each other to allow for decoding of the mass spectra and identification of precursor and fragment ions. Advantageously each spectrum might have the same or similar numbers of fragments and precursors, though differently distributed in m/z and intensities, thus avoiding the overcrowding of high energy spectra which is a symptom of the $MS^e$ technique outlined in the Background section above. Such controlled temporal distribution of intensities permits decoding independently of chromatographic separation. Thus even co-eluting analytes can be separated.

Analysis of the resultant ion population is preferably carried out using a high resolution analyzer such as an Orbital Trap, an FT-ICR Trap, or a TOF mass analyzer, or a combination of any number of these.

In accordance with the second aspect of the present invention, a tandem mass spectrometer in accordance with claim 19 is provided.

Various specific combinations of components may be employed to provide the mass filter and mass analyzer. For example, the mass filter may be a quadrupole (3D) ion trap or a linear trap. The mass analyzer may be a time of flight or orbital trap, or an FT-ICR trap. In particularly preferred embodiments, the fragmentation cell is arranged out of a path from the ion source, through the mass filter, to the mass analyzer. By placing the fragmentation cell along a spur or "dead end" path out of the path from the ion source via the mass selection device to the mass analyzer, slow fragmentation techniques such as electron transfer dissociation (ETD), electron capture dissociation (ECD); electron ionisation dissociation (EID) and the like; ozone induced dissociation (OzID), Infrared multiphoton dissociation (IRMPD) or UV dissociation may be employed.

Aspects of the present invention thus allow for modulation and de-multiplexing of multiple MS/MS spectra in parallel, thus greatly increasing the throughput compared to traditional MS/MS methods.

The method and apparatus which embody the present invention are particularly effective with modern high brightness ions sources having typical ion currents in excess of 100 pA.

The invention may be put into practice in a number of ways and various embodiments will now be described with reference to the accompanying figures.

DETAILED DESCRIPTION OF PREFERRED EMBODIMENTS

FIGS. 1 to 5, 7 and 8 show, respectively, first to seventh embodiments of tandem mass spectrometers suitable for implementation of methods which embody the present invention. Whilst each embodiment illustrates a tandem mass spectrometer which, when operated in accordance with the method to be described below, provides advantages over similar tandem mass spectrometers operated in accordance with prior art techniques, the following specific examples do nevertheless have a hierarchy of preference. In particular, the fifth, sixth, and seventh embodiments of FIGS. 5*a*, 5*b*, 7*a*, 7*b*, 8*a* and 8*b* are preferred over the fourth embodiment of FIG. 4 which is in turn more preferable than the third embodiment of FIG. 3, then the second embodiment of FIG. 2, with the first embodiment of FIG. 1 least preferred. The embodiment of FIGS. 7*a*, 7*b*, 8*a* and 8*b* provide an alternative and particularly preferred arrangement that provides a similar function to the embodiments of FIGS. 5*a* and 5*b*.

Figure 1:
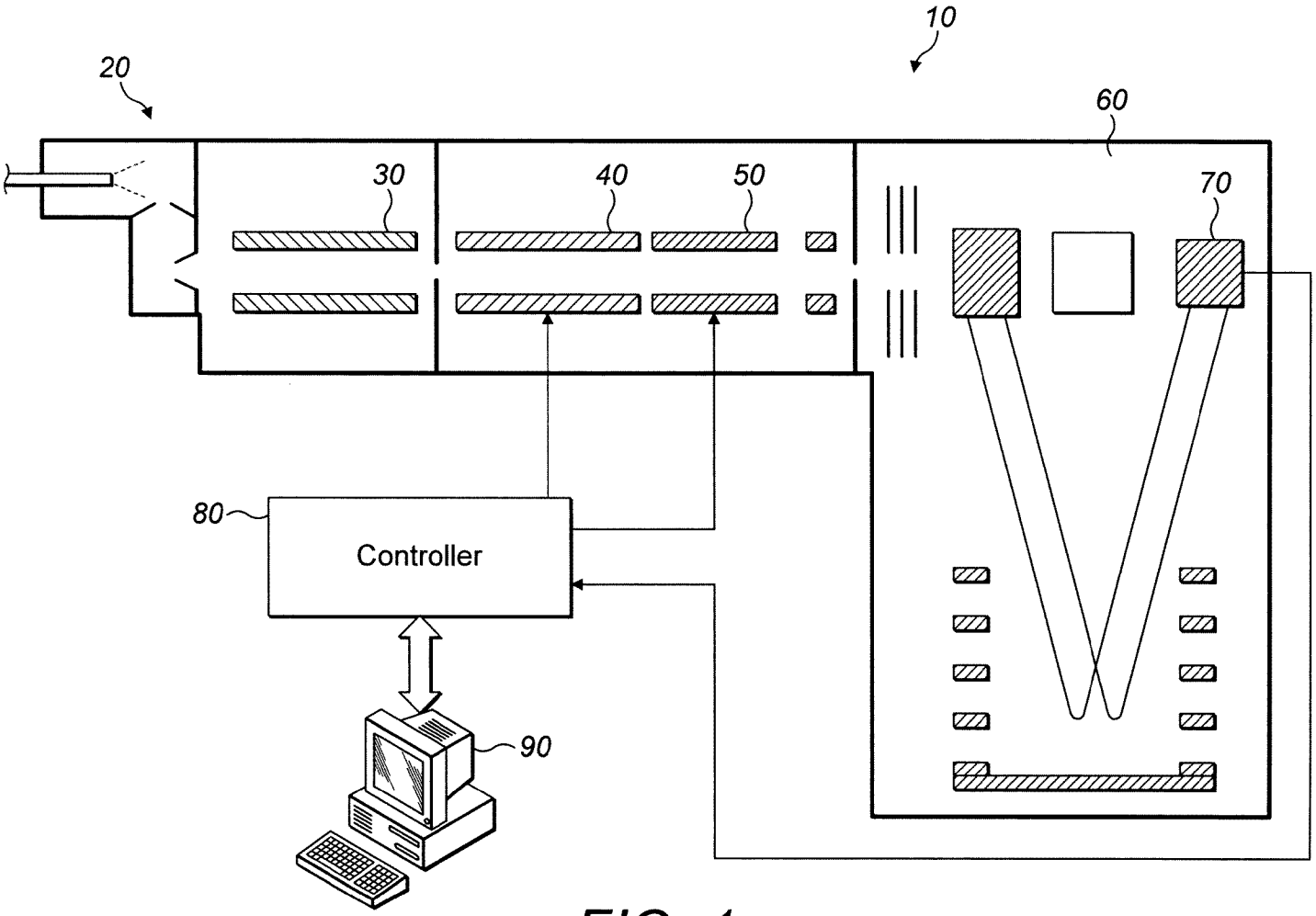
FIG. 1 shows a first embodiment of a tandem mass spectrometer suitable for implementing the invention.

Turning then first to FIG. 1, a first embodiment of an apparatus suitable for implementation of a method embodying the present invention is shown. The arrangement of FIG. 1 is referred to in the art as a Q-TOF.

In detail, the arrangement of FIG. 1 is a tandem mass spectrometer 10 having an ion source 20. The ion source 20 is, in the pictured embodiment, an electrospray ion source but may be any other suitable form of ion source, such as, for example a MALDI ion source.

Ions from the ion source 20 pass through ion optics/an ion guide 30 and into a quadrupole mass filter 40. The quadrupole mass filter 40 is capable of selecting a relatively narrow window of mass to charge ratios of ions from the ion source, dependent upon the voltages applied to the quadrupole electrodes. The ions in the relatively narrow mass window which are allowed to pass through the quadrupole mass filter 40 then enter an inline fragmentation cell 50 where they are fragmented, or not, in a manner to be described in connection with FIG. 6 below in particular. Precursor and/or fragment ions exiting the fragmentation cell 50 then pass downstream into an ultra high vacuum chamber containing a time of flight (TOF) mass spectrometer 60. Ions pass through a drift region within the time of flight mass spectrometer and are reflected back towards a detector 70. As will be familiar to those skilled in the art, ions of different mass to charge ratios separate in time of flight through the time of flight mass spectrometer 60 so that the time of arrival of ions upon the detector 70 provides an indication of mass to charge ratio.

The tandem mass spectrometer 10 is under the control of a controller 80 which, in particular (but not exclusively) controls the quadrupole mass filter 40, and the fragmentation cell 50, and receives an output from the detector 70. The controller 80 may be in communication with an external computer 90 for data storage and pre or post processing.

The operation of the apparatus of FIG. 1, but not the controller and the method by which it is employed, is set out in further detail in U.S. Pat. No. 6,586,727 and U.S. Pat. No. 6,982,414.

Figure 6:
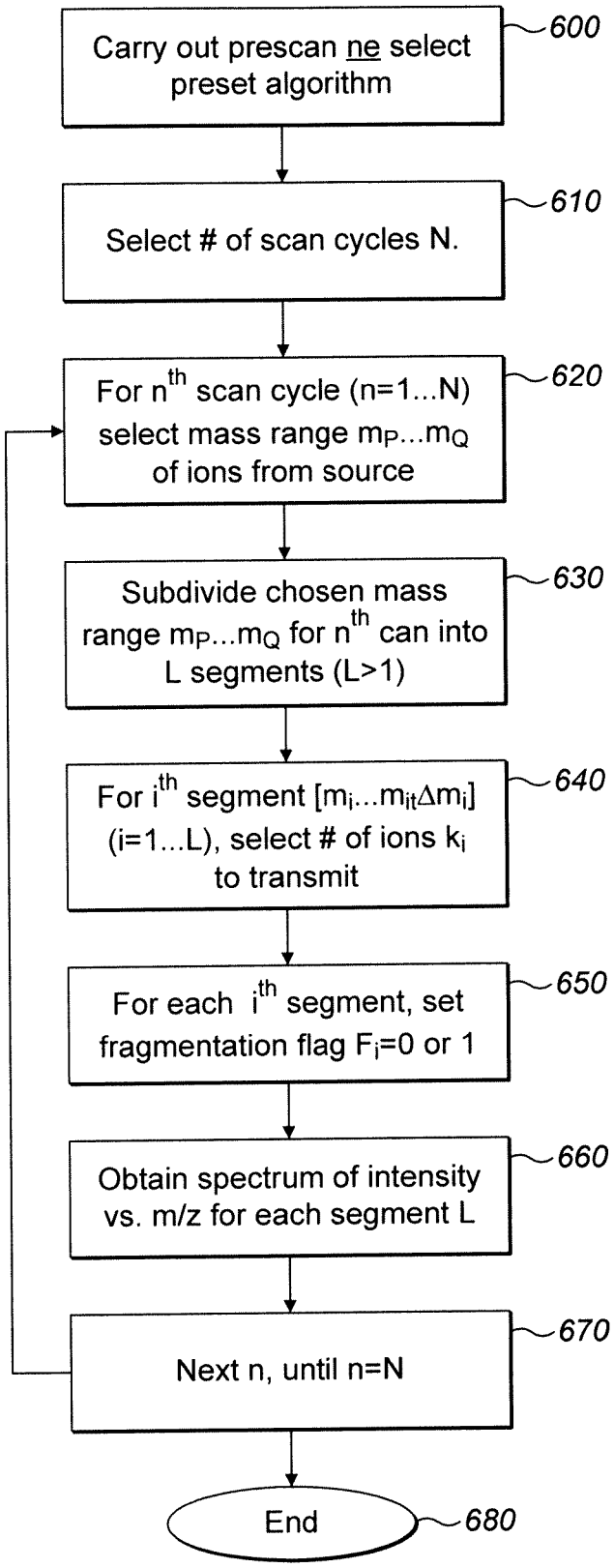
FIG. 6 shows a flow chart of steps embodying an aspect of the present invention.

Referring now to FIG. 6, a flow chart showing the steps of a method embodying the present invention is shown. The method steps will be described in connection with FIG. 6 with reference also to FIG. 1.

In a first step 600, a pre scan of the ions from the ion source 20 is carried out by the arrangement tandem mass spectrometer 10 in order to provide a coarse assessment of the contents of the analyte within the ion source. Based upon the results of the pre scan, a particular scheme or algorithm for analysis of ions from the ion source is selected. This scheme or algorithm, to be explained in connection with the remaining steps of FIG. 6 below, may either be generated in real time or may, alternatively, be selected from a "library" of preset algorithms.

As an alternative to a pre scan, particularly where a particular analyte is suspected, software operating within the controller 80 or the computer 90 (or elsewhere) may select a preset algorithm.

At step 610, a decision is taken as to the number of scan cycles that will be carried out in respect of the particular analyte. For example, a single scan cycle may be carried out so that ions between an upper and lower limit of a mass range from the ion source are analysed only once. Alternatively, however, multiple scan cycles are preferably carried out. In this case, the multiple scan cycles might be across a similar mass range of ions from the ion source, or across a different mass range and so forth. Carrying out multiple cycles of analysis of ions from an ion source permits deconvolution of MS/MS spectra, and again this procedure will be explained in further detail below with reference to FIGS. 8 and 9.

At step 620 of FIG. 6, for the particular scan cycle (and for multiple scan cycles when it is proposed to carry out such multiple cycle analysis), the relatively broad mass range of ions to be analysed from the ion source is chosen. In FIG. 6, this mass range is identified as $[M_P \ldots M_Q]$.

Next, at step 630, this relatively broad mass range is sub divided, for the $n^{th}$ scan, into L segments, where L is greater than 1. In other words, the mass range $[M_P \ldots M_Q]$ is sub divided into at least two segments.

Each $i^{th}$ segment, at step 640, is chosen to contain ions in a sub divided mass range $[m_i \ldots m_i+\Delta m_i]$ (i=1 . . . L) from the total mass range $[M_P \ldots M_Q]$. A transmission time $t_i$ of the mass filter is also chosen for that sub divided mass range. The aim is to identify a number of ions $K_i$ to be transmitted in respect of that $i^{th}$ segment.

A fragmentation flag $F_i$ is also set to 0 or 1 in respect of an $i^{th}$ one of the L segments. In a simplest embodiment, the fragmentation flag sets the fragmentation energy within the fragmentation cell 50 at either 0 volts (flag=0, "low fragmentation") or a single, relatively higher fragmentation energy $E_i$ of, say, several tens of volts, perhaps 70-80 volts (flag=1, "high fragmentation"). This ensures that essentially all precursor ions pass through the fragmentation cell 50 without fragmentation when fragmentation flag is set to 0, whilst essentially all of the precursor ions are fragmented into fragment ions when the fragmentation flag is set to 1. In all cases, however, with the fragmentation energy set at the relatively higher level there is at least a higher degree of fragmentation of the precursor ions than with the fragmentation energy set at the relatively lower level. In general, flag 0 sets the fragmentation energy within the fragmentation cell at a relatively lower fragmentation energy $E_i(E_i \geq 0)$, for example, of less than 10 volts, whereas the fragmentation flag 1 sets the fragmentation energy at a relatively higher fragmentation energy $E_i$, say, of several tens of volts, e.g. 30-80 volts. In a further embodiment, however, multiple flags may be set such as $F_i$=0, 1, . . . s, where s is less than or equal to L. This allows, for example, data dependent fragmentation energies to be employed so that ions in certain segments experience a different fragmentation energy, but a non-zero fragmentation energy nonetheless, to ions in others of the segments.

Returning again to FIG. 6, the number $K_i$ may be selected using automatic gain control (AGC), the number of ions chosen being dependent upon space charge effects and so forth. Such a technique allows, for example, compensation for the relative over fragmentation of ions of smaller mass to charge ratio or higher z, and the relative under fragmentation for ions of higher mass to charge ratio, to allow a more uniform spread of precursor and fragment ions across the full spectrum of the selected mass range $[M_P \ldots M_Q]$.

As a final stage of the procedure, for a given scan cycle n, at step 660 a spectrum is obtained of intensity versus mass to charge ratio for each of the L segments. The full spectrum, containing precursor ions from some of the segments across the mass range and fragment ions from other segments across the mass range (optionally with a combination of precursor and fragment ions from some segments), is stored within the controller and/or the external computer 90 for subsequent analysis.

The all mass MS/MS spectrum from the segmented mass range can be obtained in a number of ways. For example, in the arrangement of FIG. 1, over a first time period $t_1$, ions of a first segment i=1 of the total mass range to be analysed $[M_P \ldots M_Q]$ can be allowed to pass through the quadrupole mass filter 40 by application of appropriate voltages by the controller 80 to the rod electrodes of the quadrupole mass filter 40. This relatively limited mass range is then fragmented, or not, depending upon the flag set upon the fragmentation cell 50 by the controller 80, and passed to the time of flight mass spectrometer 60 for separation and analysis. During a short period $\Delta t_1$, the voltages upon the electrodes of the quadrupole mass filter 40 can be adjusted by the controller 80 and during this period ions may be discarded (since they may otherwise experience and indeterminate, intermediate fragmentation energy). Then, next, during a second transmission time $t_2$ for the second segment i=2, ions of a second subsidiary mass range within the overall mass range to be analysed can be transmitted through the quadrupole mass filter 40 whilst all other ions may be discarded or otherwise not passed to the fragmentation cell 50. Again, ions from across this second subsidiary mass range may be fragmented or not by the fragmentation cell 50 in accordance with the flag set upon it by the controller 80, and these ions then passed to the TOF mass analyzer 60. In that sense, a quasi continuous stream of precursor and/or fragment ions from each of the L segments, separated only by brief periods $\Delta t_i$ as the voltages upon the quadrupole mass filter electrodes are changed, are collected.

As an alternative, however, the ions output from the fragmentation cell 50 (whether unfragmented precursor ions, fragments or a combination of the two) may be stored in an external secondary ion store (not shown in FIG. 1) downstream of the fragmentation cell 50 but upstream of the TOF mass analyzer. This allows ions from multiple segments to be analysed together when that secondary ion store is emptied into the TOF mass analyzer. Since, however, one of the attractions of the Q-TOF arrangement of FIG. 1 is that it allows quasi continuous mass analysis, external storage and analysis of ions from multiple segments together is not preferred in that embodiment.

Additionally or alternatively, the techniques described in WO-A-2005/093,783 may be employed to "stitch" spectra from each, or several, of the segments L together to form a single, composite spectrum.

Once the composite spectrum for precursor and fragment ions from the whole of the mass range $M_P \ldots M_Q$ has been captured for the $n^{th}$ scan cycle, procedure is repeated for an $n+1^{th}$ scan cycle. In this subsequent scan cycle, as indicated above, one or more of the parameters may be adjusted. For example, one or more of the mass range $M_P \ldots M_Q$, the number of segments L, the width of each segment (in terms of upper and lower limits of the subsidiary mass range), transmission time for each segment, etc., can be varied.

Steps 620 to 670 are then repeated until all N scan cycles have been completed and all mass spectra stored. The procedure for the acquisition of mass spectra then terminates. Analysis and deconvolution of the spectra may then be performed as described below with reference to FIGS. 9 and 10.

The primary advantage of the method embodying the present invention when applied using the apparatus of FIG. 1 is that, relative to the traditional single-precursor MS/MS technique, it is possible to store spectra more slowly than the dwell time of the quadrupole mass filter 40. The dwell time of the quadrupole mass filter 40 might, for modern high brightness ion sources, be less than a few milliseconds. The method embodying the present invention may also be compared advantageously to the known $MS^e$ method in which only a single mass segment (L=1), i.e. the total mass range, is analysed at high and low fragmentation energies.

Figure 2:
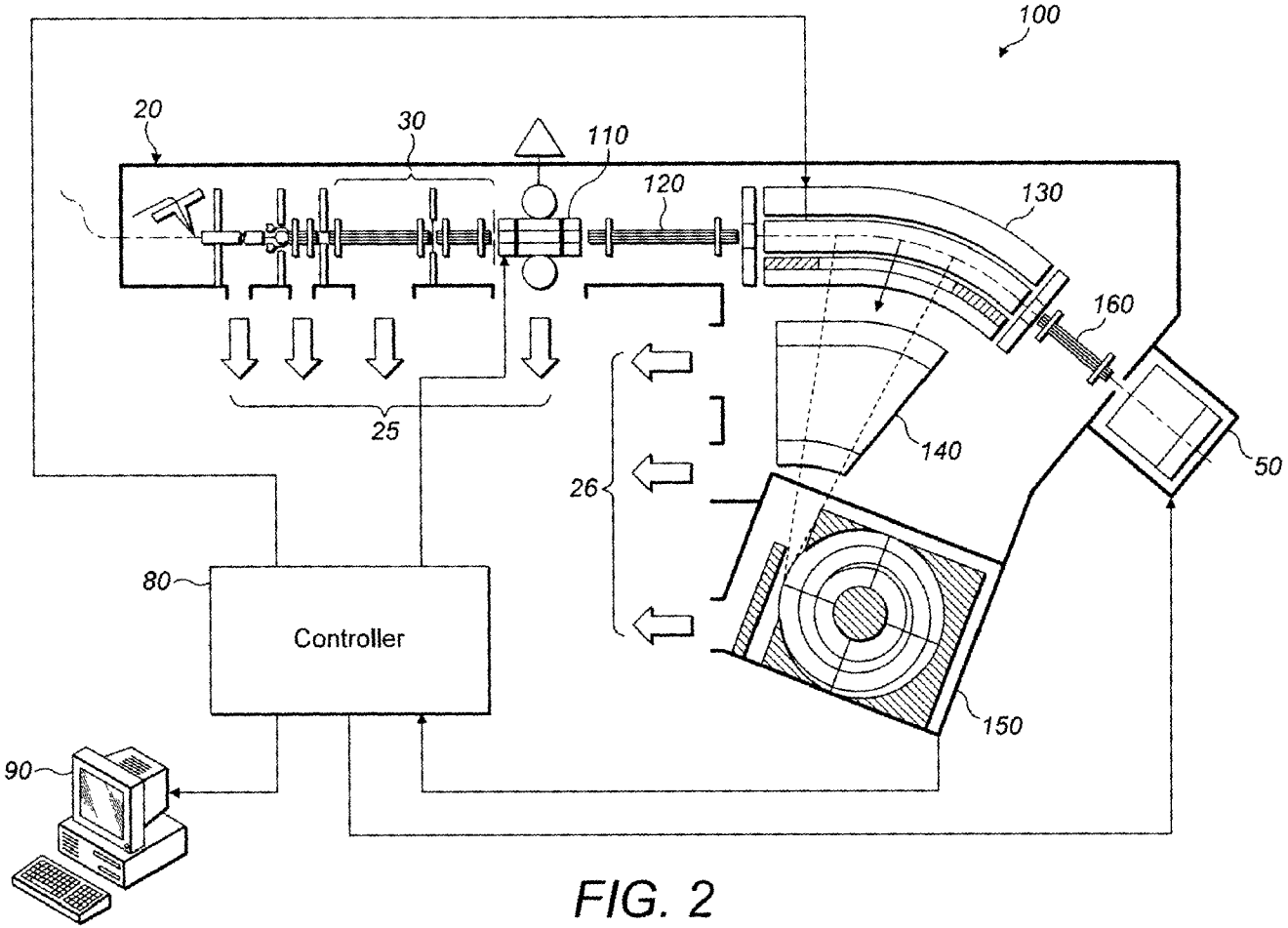
FIG. 2 shows a second embodiment of a tandem mass spectrometer for implementing aspects of the present invention.

Turning now to FIG. 2, a second embodiment of an apparatus suitable for use with the method of embodiments of the present invention is shown.

In FIG. 2, a tandem mass spectrometer 100 has an ion source 20 which, again, is shown as an electrospray ion source but might be any other suitable form of quasi continuous or pulsed ion source.

Ions from the ion source 20 pass through ion optics 30 and into a linear trap 110. The linear trap may be a quadrupole ion trap or might have higher order (hexapole or octapole) rod electrodes instead.

The linear trap 110 stores ions from the ion source 20 within a selected subsidiary mass range (segment) in accordance with the selected algorithm (FIG. 6, and step 630 in particular). Stored ions of the chosen segment are then ejected from the linear trap by adjusting the DC voltage on end caps thereof, in known manner, so that the ions pass through second ion optics 120 into a curved or C-trap 130. The C-trap 130 has a longitudinal axis which is curved as will be familiar to those skilled in the art. Ions from the linear trap 110 are transferred along the curved longitudinal axis of the C-trap 130 pass through optional third ion optics 160 into fragmentation cell 50 which is thus positioned in a "dead end" location out of the path from the source through the linear trap 110 and C-trap 130 into an orbital trap, such as an Orbitrap™ mass analyser 150.

For ions of a segment where it is intended not to fragment them (fragmentation flag F=0), offset of cell 50 is reduced so that ion energy is sufficiently low to avoid fragmentation. For ions of a segment where it is intended to fragment them (fragmentation flag F=1), offset of cell 50 is changed so that ion energy is high enough to ensure fragmentation with optimum coverage (typically, at 30-50 eV per precursor m/z 1000). As previous ion injections into cell 50 have already thermalised inside it, they are not lost or affected as additional injections are added as they remain inside cell 50 and thus do not get affected by the change of its offset. After all segments are injected and fragmented or just stored, they are ejected back through the optional third ion optics 160 into the C-trap 130 again. They are then stored along the longitudinal curved axis of the C-trap 130 before ejection orthogonally again through the ion lens 140 and into the Orbitrap™ mass analyzer 150.

An image current obtained from ions is subjected to a Fourier transform so as to produce a mass spectrum as is known in the art.

As a variant of this method, all of the segments could be processed in two steps: in a first step, only those segments with F=1 are injected into the fragmentation cell 50, are stored there and then are returned back into the C-trap 130. In a second step, all of those segments with F=0 are transmitted into the C-trap without ever entering the fragmentation cell 50. This approach is employed in preference when non-collisional activation is used in the fragmentation cell 50, such as electron transfer dissociation (ETD), electron capture dissociation (ECD); electron ionisation dissociation (EID) and the like; ozone induced dissociation (OzID), IRMPD, UV dissociation, and so forth. In effect, this technique is equivalent to splitting the fragmentation cell 50 into two regions: one free from activation and another subject to activation.

The various components of the tandem mass spectrometer 100 of FIG. 2 are under the control of a controller 80 again. The controller controls the linear trap 110 so as to adjust the voltages on the rods and the DC voltage on the end caps, in turn to select a particular mass range and then eject it to the C-trap. The controller controls the C-trap 130 to eject the received ions there orthogonally to the Orbitrap™ 150 and/or axially to the fragmentation cell, in accordance with the preselected algorithm. The controller also controls the fragmentation cell itself so that an appropriate fragmentation energy (or energies) can be applied to the ions in respect of each segment. Finally, the controller 80 may be configured to receive the data from the image current detector of the Orbitrap™ mass analyzer 150 for processing and/or onwards transmission to an external computer 90.

Each of the components within the tandem mass spectrometer 100 will, of course, reside in vacuum chambers which may be differentially pumped and the differential pumping is indicated at reference numerals 25 and 26 in FIG. 2.

The method of use of the apparatus of FIG. 2 follows the steps of FIG. 6 again. As with the arrangement of FIG. 1, a secondary storage device may be located downstream of the fragmentation cell 50 so that ions from multiple segments may be collected together before analysis in a single stage in the Orbitrap™ mass analyzer 150.

The advantage of the method embodying the present invention, when applied to the apparatus of FIG. 2, results from the fact that, normally, fill time for a broad mass range spectrum will be more than tens times shorter than the shortest detection cycle of the Orbitrap™ analyzer. Therefore, this "free" time can be used for filling the C-trap 130 or the secondary ion storage device with different sub populations of ions with controlled intensities, degrees of fragmentation and so forth.

From a practical point of view, it is beneficial in the arrangement of FIG. 2 to restrict the segmentation of a mass range to fewer than 20 segments with the total mass range analysed (that is, $M_P \ldots M_Q$) between 10 and 100,000 amu, most typically m/z 100 to 2000. Finally, a total transmission time $\Sigma t_i$ of the mass filter of less than 0.2 seconds is preferred. With this arrangement, there is a big gain relative to the traditional single-precursor MS/MS approach which is limited by the acquisition rate of the Orbitrap™ analyzer. Instead of the Orbitrap™ analyzer 150, furthermore, any other mass analyzing electrostatic trap or high-resolution TOF or FTICR could be employed.

Figure 3:
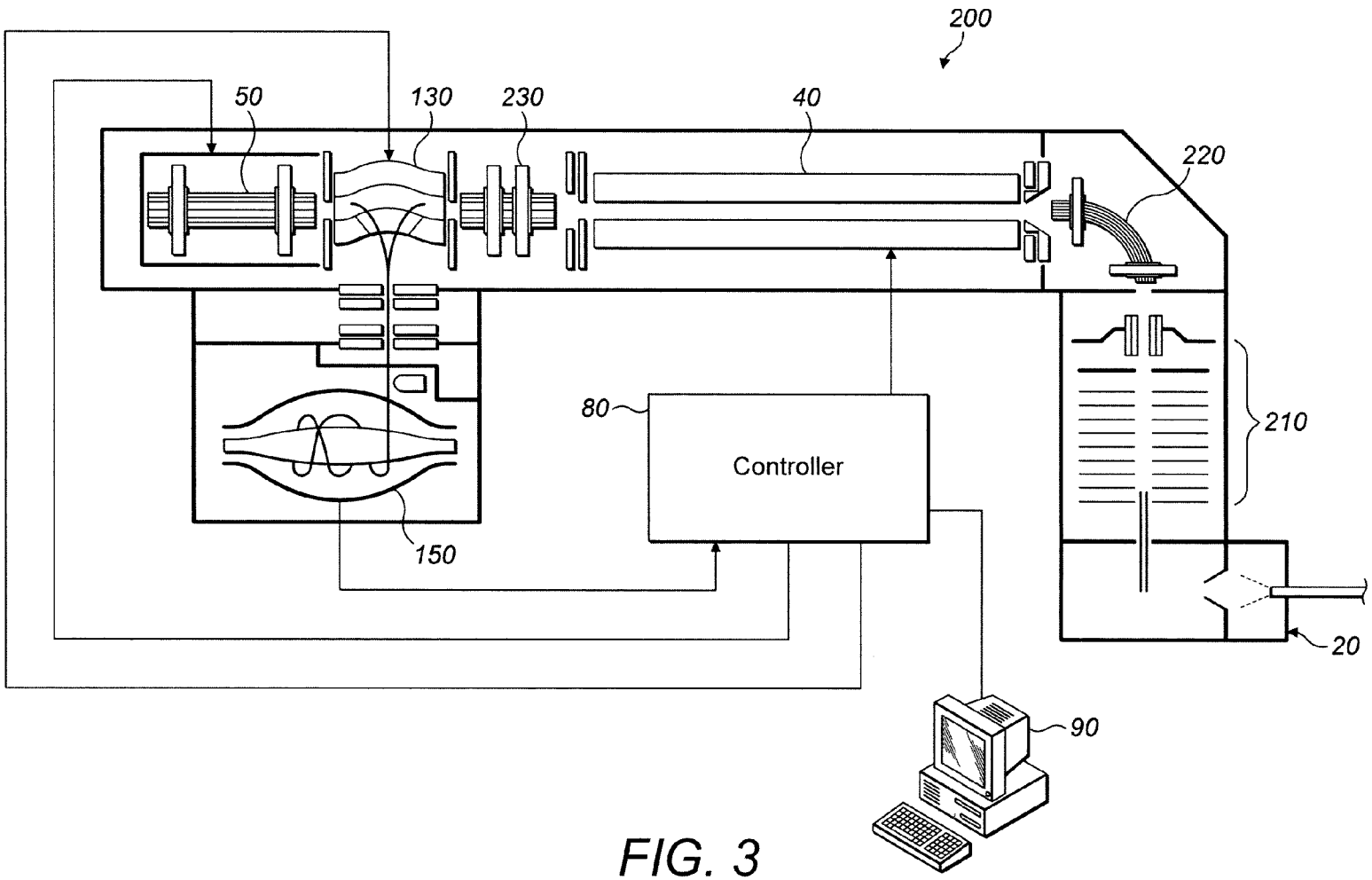
FIG. 3 shows a third embodiment of a tandem mass spectrometer embodying aspects of the present invention.

FIG. 3 shows a third embodiment of an apparatus suitable for use with the method embodying the present invention. In brief, this apparatus is a quadrupole/Orbitrap™ hybrid, again with the collision cell in a "dead end" location. The apparatus, but again not the specific methodology for its control, is described in further detail in our currently unpublished, copending application number GB 1108473.8 filed 20 May 2011 entitled "Method and apparatus for mass analysis".

In detail, a tandem mass spectrometer 200 in accordance with the arrangement of FIG. 3 includes an ion source 20 (again, an electrospray ion source is shown schematically but other ion sources can be employed). Ions from the ion source pass through an rf only S-lens 210 and into a bent flatapole 220. This arrangement is rf only and the amplitude of the voltage applied to the flatapole 220 is mass dependent.

Ions exiting the flatapole 220 enter a quadrupole mass filter 40. Here, a subset of ions for a given $i^{th}$ segment is selected, as previously, and these are then injected axially to a fragmentation cell 50 for fragmentation or storage and return to the C-trap 130, again for orthogonal ejection of these fragment ions to the Orbitrap™ mass analyzer 150.

A controller 80 once again controls the voltages to the quadrupole mass filter 40, the C-trap 130, the fragmentation cell 150 and the other components of the system (not shown for clarity). The output of the image current detector of the Orbitrap™ mass analyzer 150 is connected to the controller for processing and/or transmission to an external computer 90.

The methodology employed in respect of FIG. 3 is again as described in connection with FIG. 6. The advantages of the arrangement of FIG. 3 are essentially the same as those described above in connection with FIG. 2, namely that the fill time for a broad mass range spectrum is at least ten times shorter than the shortest detection cycle of the Orbitrap™ mass analyzer 150. A similar mass range and number of segments to that explained above in connection with FIG. 2 is preferable, and likewise a similar total transmission time of the mass filter.

One of the benefits of the "dead end" configuration of the reaction cell 50 shown in FIGS. 2 and 3 is that it permits relatively slow fragmentation methods such as electron transfer dissociation (ETD), electron capture dissociation (ECD); electron ionisation dissociation (EID) and the like; ozone induced dissociation (OzID), IRMPD, UV dissociation, and so forth to be employed. This in turn greatly enhances the utility of the method and apparatus.

Figure 4:
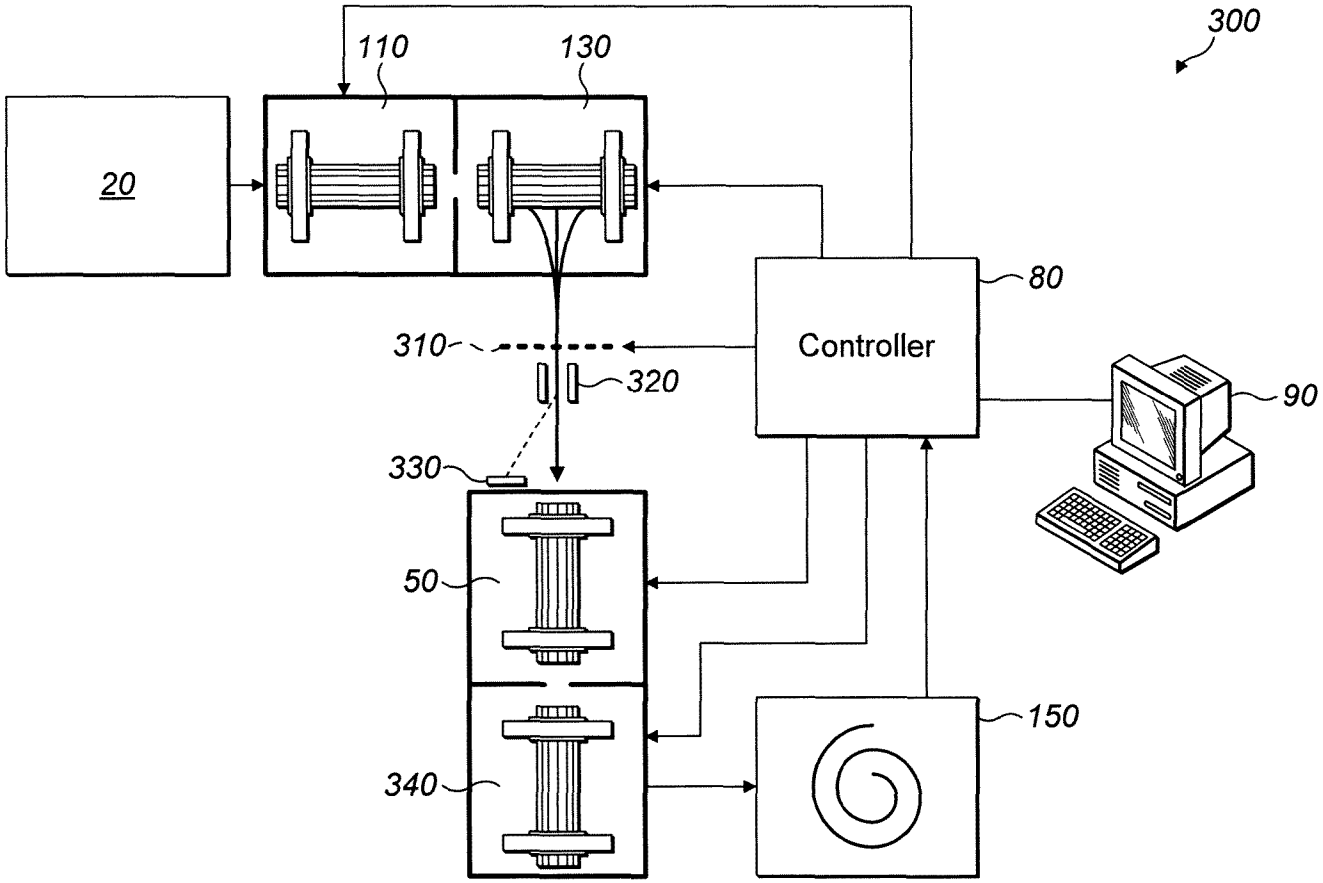
FIG. 4 shows a fourth embodiment of a tandem mass spectrometer embodying aspects of the present invention.

FIG. 4 shows a fourth embodiment of a tandem mass spectrometer suitable for implementation of a method embodying the present invention. The arrangement of FIG. 4 is, in a broadest sense, similar with the arrangement of FIG. 2 in that it comprises a linear trap and Orbitrap hybrid combination. In contrast to FIG. 2, however, the arrangement of FIG. 4 uses an in-line collision cell as will be explained, and, moreover, makes use of the ion selection and gating technique described in our copending, as yet unpublished, application number PCT/EP2012/061746, entitled "Targeted analysis for tandem mass spectrometry", the contents of which are incorporated by reference.

In the arrangement of FIG. 4, an ion source 20 generates sample ions. The ion source may, once again, be either an electrospray ion source, a MALDI ion source, or otherwise. Ions from the ion source 20 enter a linear trap 110 via ion optics which are not shown in FIG. 4. Ions accrue within the linear trap 110. Unlike earlier embodiments, however, the linear trap 110 is, preferably, not set to select segments. Instead, the linear trap collects and cools ions across the full mass range of interest for a particular cycle, that is, the full mass range $M_P \ldots M_Q$. Once the ions across the mass range have been accumulated in the linear trap 110 they are ejected by adjusting the DC voltages on the end caps of the linear trap 110 through further ion optics (not shown) into a second linear trap, which is preferably a C-trap, 130.

From here, the ions are ejected orthogonally towards a fragmentation cell 50. However, between the C-trap 130 and the fragmentation cell 50 is an ion gate 310 and a pulsing device 320 (which is optional), along with an ion stop or electrometer 330. As is explained in further detail in the above referenced PCT/EP2012/061746, the ion gate 310 may be, for example, a Bradbury-Nielsen gate.

Ions separate in time between the C-trap 130 and the ion gate 310 so that they arrive as packets in accordance with their mass to charge ratios. The ion gate 310 and/or pulsing device 320 are controlled by a controller 80 so as to permit passage of particular ion packets of interest to the fragmentation cell 50, or to deflect ion packets not of analytical interest out of the path into the fragmentation cell and instead onto the ion stop or electrometer 330.

Thus it will be understood that the source 20, linear trap 110 and C-trap 130, together with the ion separation device comprised of the ion gate 310, pulsing device 320 and ion stop 330 permit all of the L segments to be accumulated and transmitted in parallel. The controller 80 subdivides the full mass range of interest for a particular scan cycle, $M_P \ldots M_Q$ into L time segments and switches the flag on the fragmentation cell 50 to $F_i$=0 or $F_i$=1 independently for each $i^{th}$ segment in accordance with the desired fragmentation scheme. The ion gate 310 acts primarily to control the ion population $K_i$ for a particular $i^{th}$ segment, that is, the controller operates the ion gate to allow passage, or deflects ions away from, the fragmentation cell 50 so that the appropriate number of ions in a given segment enter the fragmentation cell. That controlled ion population is then fragmented, or not, in accordance with the flag that is set upon the fragmentation cell.

While the gate 310 is used mainly to control the transmitted number of ions $K_i$, the switching of the fragmentation mode from F=0 to F=1 is done by changing the offset voltage of the fragmentation cell 50. There is a finite time to change the voltage on the fragmentation cell and, in turn, adjust the fragmentation energy from flag F=0 to flag F=1. Typically, the voltage offset change time is a few tens up to a few hundreds of nanoseconds. During the period of change, from F=1 to F=0 or F=0 to F=1, the controller may control the ion gate 310 such that substantially no precursor ions are permitted to enter the fragmentation cell during the changeover time period.

As the stream of ions from the successive ion segments enter the fragmentation cell 50 they are fragmented or not in accordance with the fragmentation scheme independently applied for each segment, and precursor and/or fragment ions exit the fragmentation cell 50 axially into an external ion trapping device 340 which may be a second C-trap. In preference, and again as is explained in further detail in PCT/EP2012/061746, the precursor and/or fragment ions from all of the segments L are stored together in the external ion trapping device 340. Then, the mixture of precursor and fragment ions from the subdivided total mass range of interest for a particular scan cycle are ejected, orthogonally, to an orbital trap 150, such as an Orbitrap™ mass analyzer, for analysis. The resultant transient or transformed mass spectrum is then stored for subsequent analysis, at the controller 80, at an external computer 90, or elsewhere.

The detection or summation cycle in the orbital trap 150 may be considerably longer than the cycle time of the C-trap 130. Thus in the embodiment of FIG. 4, the transmission time $t_i$ is the sum of, potentially, multiple cycles of the C-trap 130 for which ions from an $i^{th}$ segment are allowed to enter the fragmentation cell 50 to build up required number of ions $K_i$. That is to say, multiple cycles of filling and ejection of the C-trap 130 may be carried out even within a single scan cycle, with similar multiple filling and emptying cycles of the C-trap 130 in subsequent scan cycles wherein the mass range to be investigated, the number of segments and so forth is changed.

In the embodiment of FIG. 4, it is desirable though not essential that segmentation is limited to 100 segments or fewer. The mass range that may be investigated is preferably between 50 and 2,000 m/z. The transmission time $t_i$ is preferably less than 0.1 second.

Figure 5A:
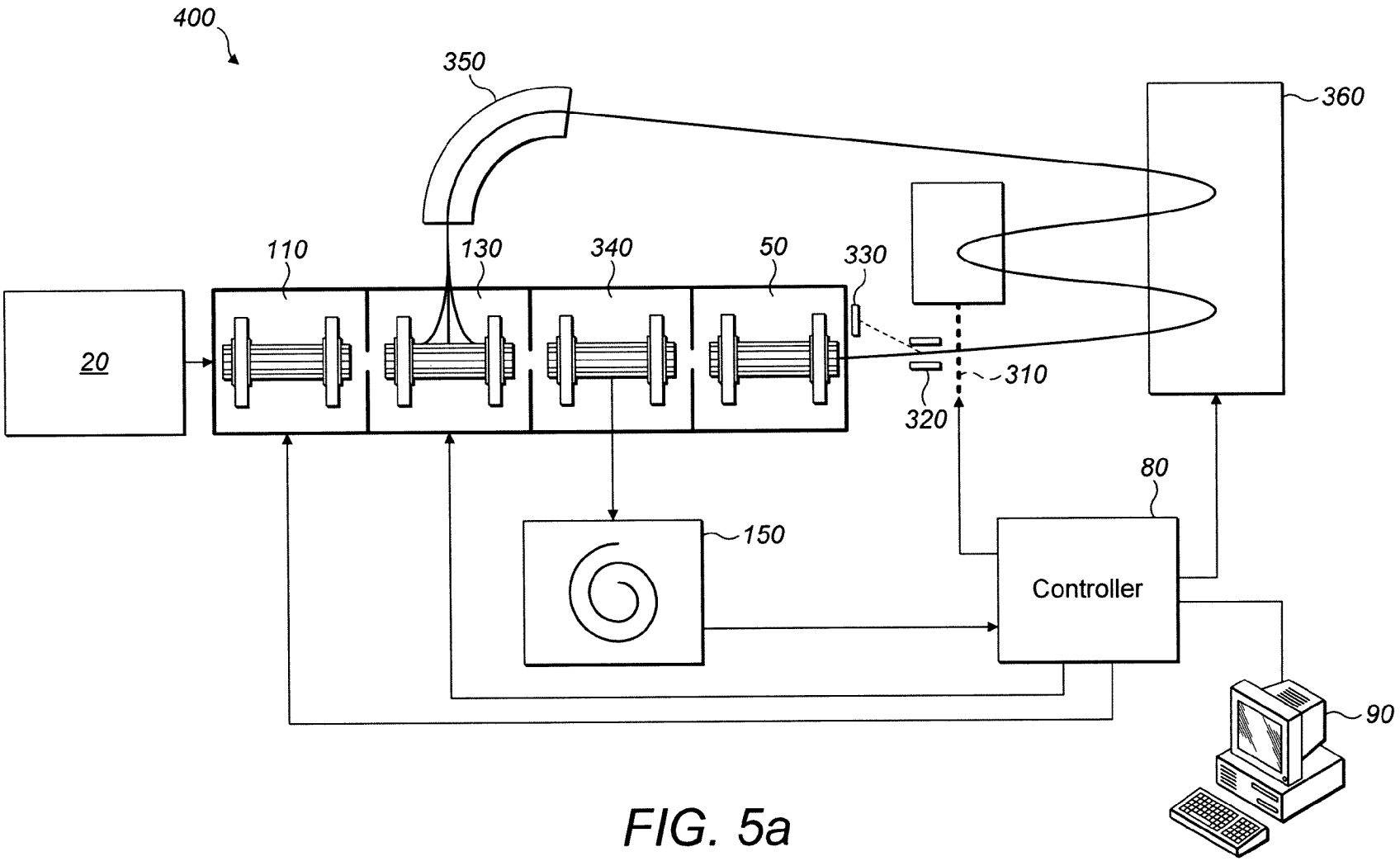
FIG. 5A and FIG. 5B show fifth and sixth embodiments of aspects of the present invention.

FIG. 5A shows yet another, fifth embodiment of a tandem mass spectrometer 400 which is a TOF-orbital trap hybrid. The arrangement of FIG. 5A employs an in-line collision cell and is based upon the arrangement described in the above referenced PCT/EP2012/061746. As with the arrangement of FIG. 4, ions from a suitable ion source 20 such as an electrospray or MALDI ion source are directed toward a linear trap 110 which stores and cools ions across the full mass range of interest [$M_P$ . . . $M_Q$]. From here, ions pass through ion optics (not shown) into a linear trap such as a C-trap 130. Ions are ejected orthogonally from the C-trap 130 and pass through an optional electric sector 350 into either a single or multi-reflection time of flight (MR-TOF) analyzer 360 which allows time of flight separation of ions in accordance with their mass to charge ratio, whilst maintaining a relatively compact package. Although a single or multi-reflection time of flight device 360 is described, it will be appreciated that alternatively a multi-sector time of flight analyzer such as the "MULTUM" device, or an orbital time of flight mass analyzer, as described in WO 2010/136533 for example, could be employed instead.

Once ions have passed through the MR-TOF 360, they arrive at the ion gate 310. As with the arrangement of FIG. 4, ions are controlled at the ion gate so that they either enter a fragmentation cell 50 or are deflected, using the ion gate 310 and an optional pulsing device 320 towards an ion stop 330. Again the arrangement of FIG. 5A is intended to collect and analyze all L segments in parallel, so that the ion gate 310 is preferably employed for ion population control within each segment, and also to divert incident precursor ions away from the fragmentation cell 50 whilst the collision energy is being adjusted. All of the control is derived from a controller 80 which is in communication with the linear trap 110, the curved trap 130, the MR-TOF 360 and the ion gate 310. Again, as with the arrangement of FIG. 4, downstream of the fragmentation cell 50 is an external ion trapping device 340 such as a curved or C-trap which receives the ions from each segment which have been fragmented, or not, by the fragmentation cell 50, accumulates them altogether in preference, and then ejects all of the combined precursors and/or fragments to an orbital trap mass analyzer 150 for analysis and detection. Again a computer 90 may be in communication with the controller 80 for data storage and post processing. Multiple cycles can be carried out using the apparatus of FIG. 5A.

Figure 5B:
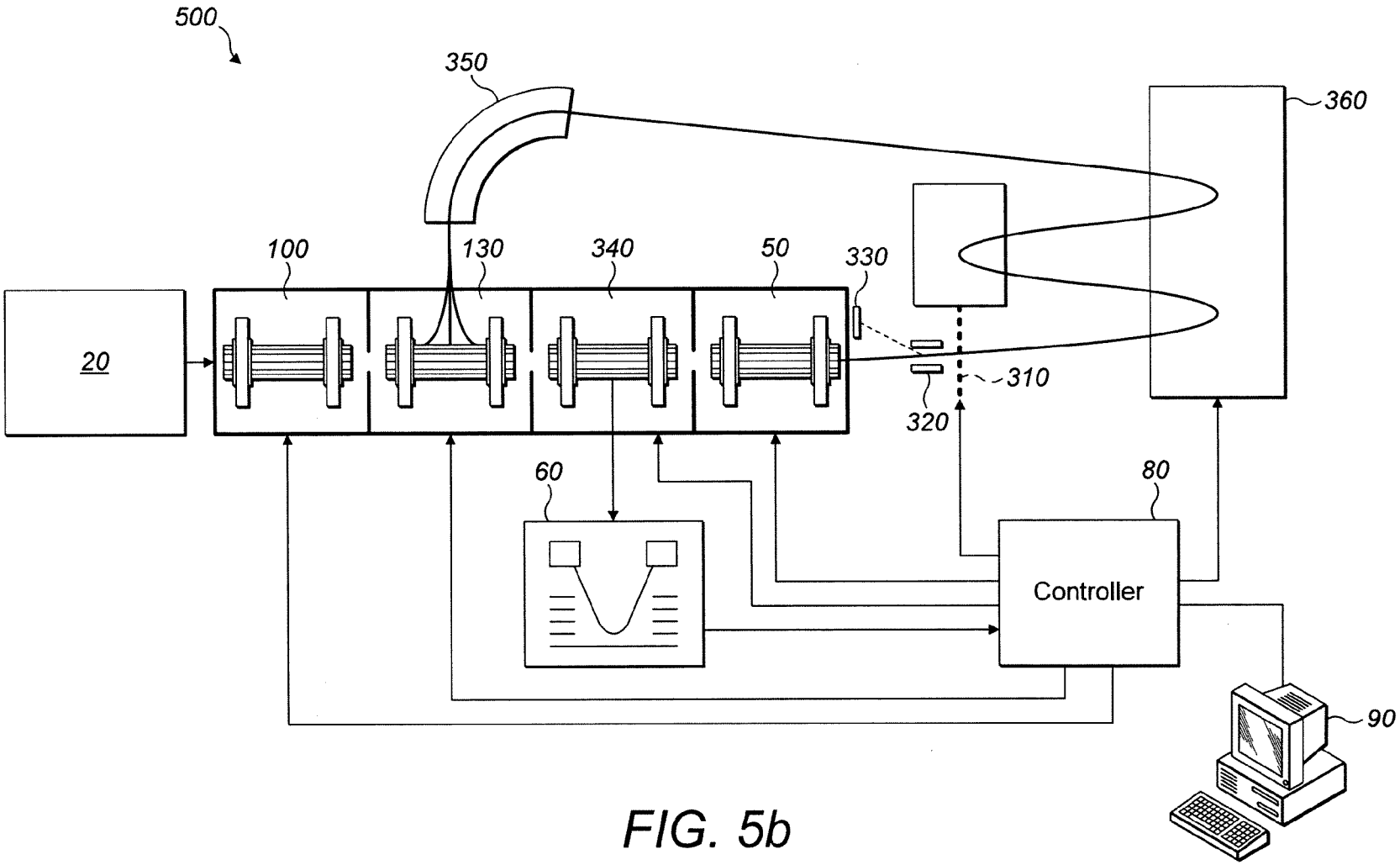

A sixth embodiment of a tandem mass spectrometer 500 which is suitable for implementation of the method described in connection with FIG. 6 above is shown in FIG. 5B. The arrangement of FIG. 5B is essentially identical with the arrangement of FIG. 5A, save that the analysis of the mixture of precursor and fragment ions from the external ion trapping device 340 is carried out by a time of flight mass analyzer 60 rather than an orbital trap 150. Since all of the other components of FIG. 5B correspond exactly with the components of FIG. 5A, they are labelled with like reference numerals and no further description will be provided.

The considerations discussed above in respect of the arrangement of FIG. 4 apply equally to the arrangements of FIGS. 5A and 5B. In particular, because the detection or summation cycle in the orbital trap 150 of FIG. 5A and the TOF mass analyzer 60 of FIG. 5B is typically considerably longer than the cycle time of the C-trap 130, $t_i$ is the sum of all cycles of the C-trap 130 for which ions from the $i^{th}$ segment are allowed to enter the fragmentation cell 50 to build up the required number of ions $K_i$. Furthermore, the segmentation (L) is preferably limited in the embodiments of FIGS. 5A and 5B to 100 or fewer segments and the mass range is typically between 50 and 4,000 m/z. The transmission time $t_i$ of 0.1 seconds or shorter is also preferred.

As a variant of the embodiments of FIGS. 4, 5A and 5B, the ion gate 310 may, instead of directing the ions of a particular segment into cell 50 where it is not intended to fragment them (F=0), direct them directly into the external ion trapping device 340 rather than allowing them to pass, without fragmentation, through the fragmentation cell 50. This can be achieved by the inclusion of suitable ion guides along a path out of that which enters the fragmentation cell 50. Alternatively, the fragmentation cell 50 may be located behind the external ion trapping device in a "dead end" configuration; that is, the external ion trapping device 340 is placed upstream of the fragmentation cell 50 so that the fragmentation cell 50 is out of a direct line between the C-trap 130, the ion gate 310, the external ion trapping device 340 and the orbital trap 150 or TOF mass analyzer 60. Ions are then ejected from the external ion trapping device 340, which, as mentioned, may in preference be a C-trap along a longitudinal axis direction to the dead-end fragmentation cell 50, where fragmentation takes place and ions are then returned to the external ion trapping device 340 again along a longitudinal axis direction for subsequent orthogonal ejection to the orbital trap 150 or time of flight mass analyzer 60. Such a "dead end" configuration allows compatibility with the relatively slow fragmentation methods mentioned above.

Referring now to FIGS. 7*a*, 7*b*, 8*a* and 8*b*, a seventh and particularly preferred embodiment of an apparatus embodying the present invention is shown. In these Figures, the trap 130 is replaced by a non-trapping orthogonal accelerator, operated at higher repetition rates (preferably, 20-100 kHz) to provide a high duty cycle and hence transmission. This allows a higher resolution to be achieved over the same length of TOF separator, though it does pose stricter requirements on the gate 310. Preferably, the orthogonal accelerator is gridless as described in WO-A-01/11660, and an optional lens is used to focus ions onto the entrance of the storage device.

Figure 7A:
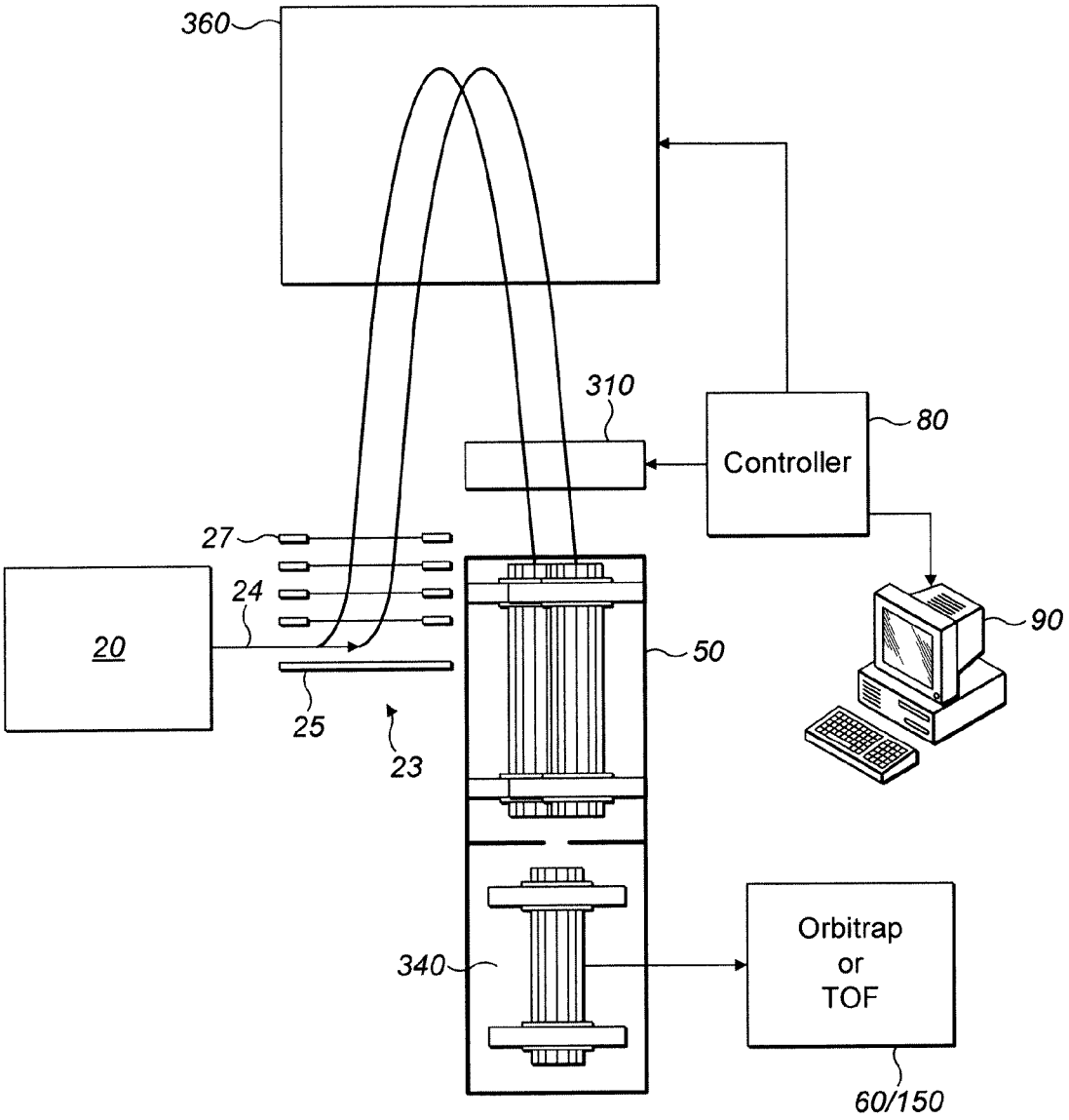
FIG. 7A and FIG. 7B show side and top views of a seventh embodiment of aspects of the present invention, including a non trapping orthogonal ion accelerator.
Figure 7B:
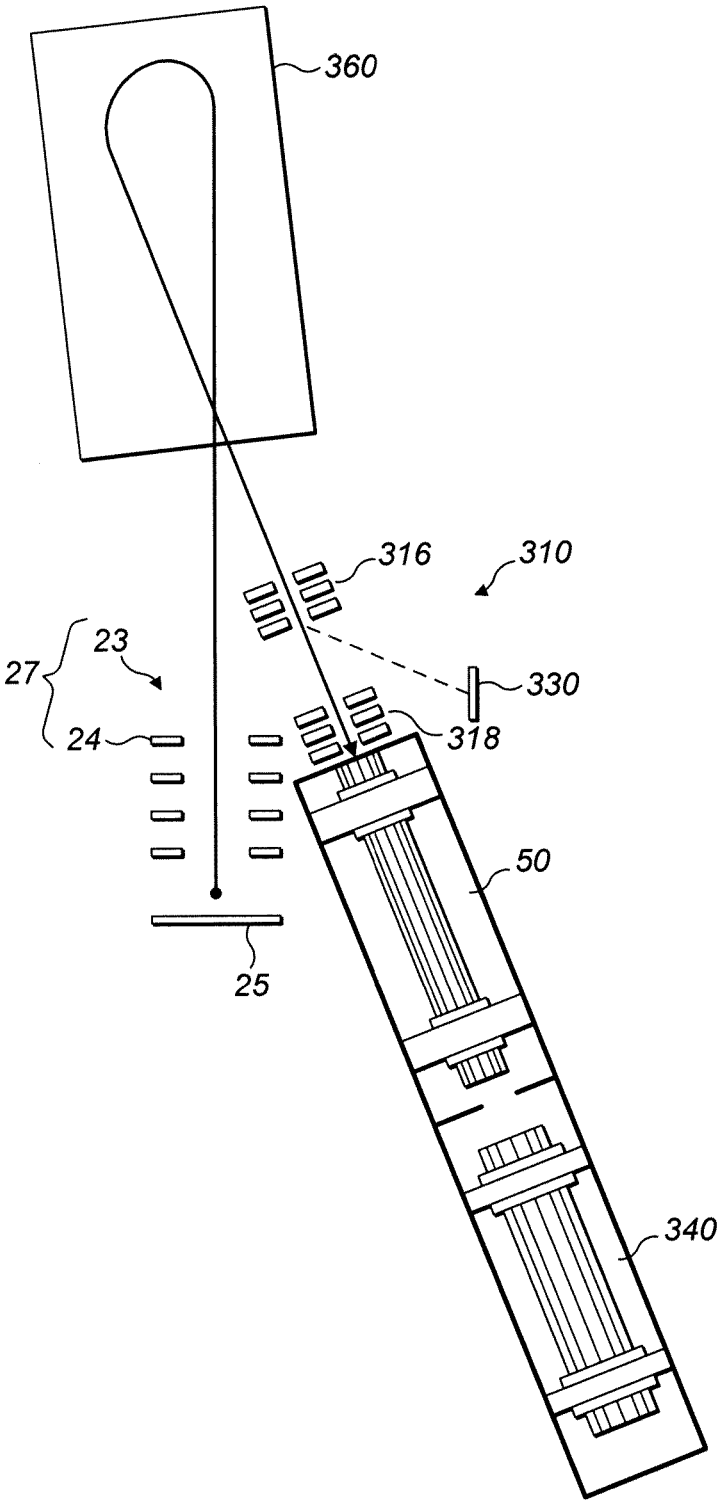

In further detail, and referring first to FIGS. 7*a* and 7*b*, a tandem mass spectrometer in accordance with a seventh embodiment of the present invention is shown. Components common to the embodiments of FIGS. 1-5 and 7*a*/7*b* are labelled with like reference numerals.

Ions are generated, as previously described, in the ion source 20. From these they are ejected into an orthogonal accelerator 23. In the embodiment of FIG. 7*a*, the orthogonal accelerator 23 is implemented as a pair of parallel plates 24, 25. The parallel plate 24 acts as an extraction plate having a grid or, most preferably, a slit for extraction of a beam, as is described for example in WO-A-01/11660. Ions enter the accelerator 23 when no DC voltage is applied across it. After a sufficient length of ion beam has entered the accelerator 23, a pulsed voltage is applied across the accelerator and ions are extracted via lenses 27 into a TOF analyser 360. Depending upon the quality of isolation required, the TOF analyser 360 may be a multi-reflection TOF, a multi deflection TOF or a single reflection TOF. A single reflection TOF is shown.

Due to the very high ion currents present, it is highly desirable that there are no grids in the ion path within the TOF 360, so as to avoid the presentation of metallic surfaces upon which ions may be deposited, in the ion path from source to detector. FIG. 7*b* is a side view of the tandem mass spectrometer in accordance with the third embodiment, using the example of a single-reflection TOF 360. As may be seen in FIG. 7*b*, ions follow a y-shaped trajectory in the single reflection TOF 360, in a gridless mirror 32. Further details of the exemplary arrangement of TOF 360 as shown in FIG. 7*b* in particular are given in WO-A-2009/081143.

On the return path from the TOF 360, ions are gated by an ion gate 310, with ions of interest being allowed to enter a fragmentation cell 50 and undesired ions being deflected to an ion stop 330. Preferably, the ion gate 310 is gridless and contains a pulsed electrode 316 surrounded by apertures that limit the penetration of the field from the pulsed electrode 316. Optionally, these apertures could have time-dependent voltages applied to them, in order to compensate field penetration from the pulsed electrode 316.

After selection on the basis of their arrival time, ions enter a decelerating lens 318 where their energy is reduced to the desired value. Although not shown, the ions may also undergo deceleration prior to entry into the fragmentation cell 50. Typically, the desired final energy for fragmentation might be estimated between 30-50 eV/kDa, where nitrogen or air is employed as a collision gas. This estimated final energy scales inversely proportional with gas mass, however, so that the final energy might exceed 100-200 eV/kDa if Helium is used as a collision gas. Similarly, for minimal or no fragmentation, the desired final energy is <10 eV/kDa where the collision gas is nitrogen or air, and <30-50 eV/kDa where Helium is employed as a collision gas. To allow deceleration to such low energies, it is preferable that ions are not excessively accelerated in the first place—preferably by not more than 300-500 V.

A typical example of a suitable deceleration lens is presented in P. O'Connor et al. J. Amer. Soc. Mass Spectrom., 1991, 2, 322-335. For a 1 meter flight path in the TOF 360, a resolution of selection of 500-1000 is expected, which is considered adequate for most applications. Due to the y-shape of the ion trajectory, ions arrive in the plane above the orthogonal accelerator 23 such that their initial energy can be chosen independently of the acceleration energy. This differs from conventional orthogonal acceleration TOFs, and allows an improvement in the duty cycle and transmission of ions. Typically, the TOF 360 operates at about a 10 kHz repetition rate so that each pulse ejects up to 105-106 elementary charges.

Because the ion packets typically arrive at the fragmentation cell 50 as elongated threads, consideration should be given to a design of the fragmentation cell 50 so that it might accept such packets. In presently preferred embodiments, this is achieved by implementing the fragmentation cell 50 as an elongated collision cell with differential pumping, similar to the collision cell described in WO-A-04/083,805 and U.S. Pat. No. 7,342,224.

Following fragmentation in the fragmentation cell 50, ions are mixed together and analyzed in the same manner as is described above in respect of the arrangements of FIGS. 1-5*a*/5*b*, by ejection into an optional external ion trapping device 340 with orthogonal ejection from that into a high resolution mass analyser: either a single- or a multi-reflection, or a multi-sector time of flight mass analyzer 60 could be used, or orbital trap 150 such as a Orbitrap 60.

Figure 8A:
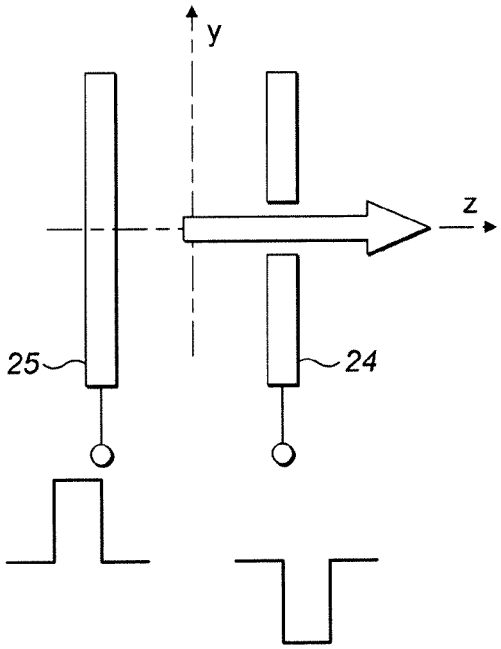
FIG. 8A and FIG. 8B show alternative arrangements of the orthogonal ion accelerator of FIGS. 7*a* and 7*b;*
Figure 8B:
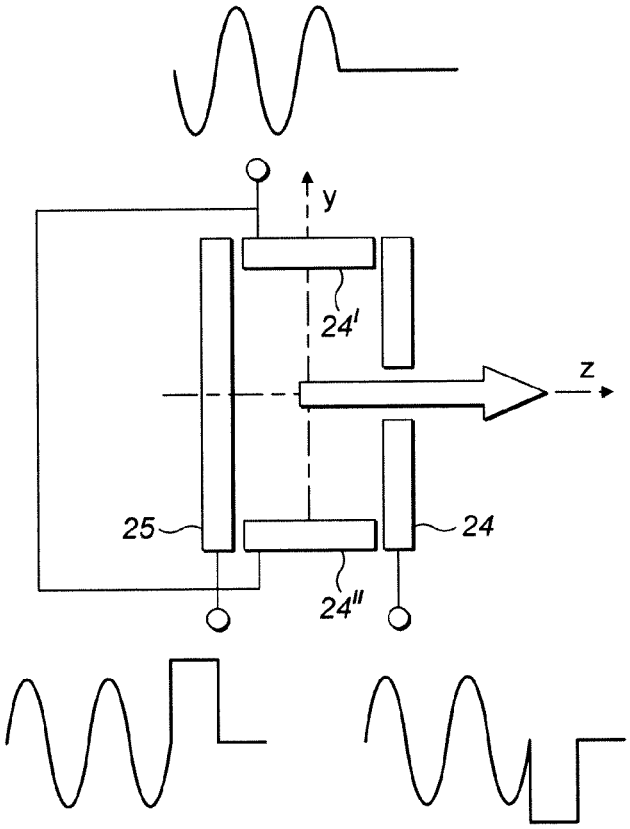

FIGS. 8*a* and 8*b* show first and second arrangements of non-trapping orthogonal ion accelerators 23 either of which may be employed as alternatives to the non-trapping orthogonal accelerator 23 of FIGS. 7*a* and 7*b*. The non-trapping ion accelerator of FIG. 8*a* is a DC ion guide whereas that of FIG. 8*b* is an RF ion guide.

In FIG. 8*a*, ions arrive from the ions source in a direction "y". The electrode 25 and 24 (the latter of which has a central slot) are held at the same DC voltage until extraction voltage pulses are applied which result in ions being ejected in pulses through the slot in the electrode 24 in a direction "z" orthogonal to the input direction "y".

FIG. 8*b* shows another alternative arrangement in which, again, ions arrive from the ion source in a direction "y" and in which RF potentials on the electrodes 25, 24 are held the same until extraction pulses are applied. In particular, in FIG. 8*b*, in addition to the back place and front extraction electrodes 25, 24, the accelerator 23 further comprises top and bottom electrodes 24' and 24" which utlize an RF phase which is opposite to that upon electrodes 24 and 25. U.S. Pat. No. 8,030,613 describes a technique for applying switchable RF to an ion trap. The technique described in this publication can however equally be applied to the non trapping RF only ion guide of FIG. 8*b* so that the RF is switchable off in accordance with the principles described in that document and pulses are applied to electrode 25 and/or 24 to extract the ions through the slot in the electrode 24.

In a preferred embodiment, the accelerator 23 of FIG. 8*b* in particular may be provided with a damping gas to reduce the energy spread of ions.

A dead-end fragmentation cell configuration similar to that shown in FIG. 3 and described as an optional alternative to the in-line fragmentation cell configuration shown in FIGS. 5A and 5B is also possible.

The techniques embodied herein find practical use across many areas of research and commercial analysis, such as, for example, quantitative analysis of complex mixtures in proteomic, metabolomic, clinical, food, environmental or forensic applications.

Figure 9:
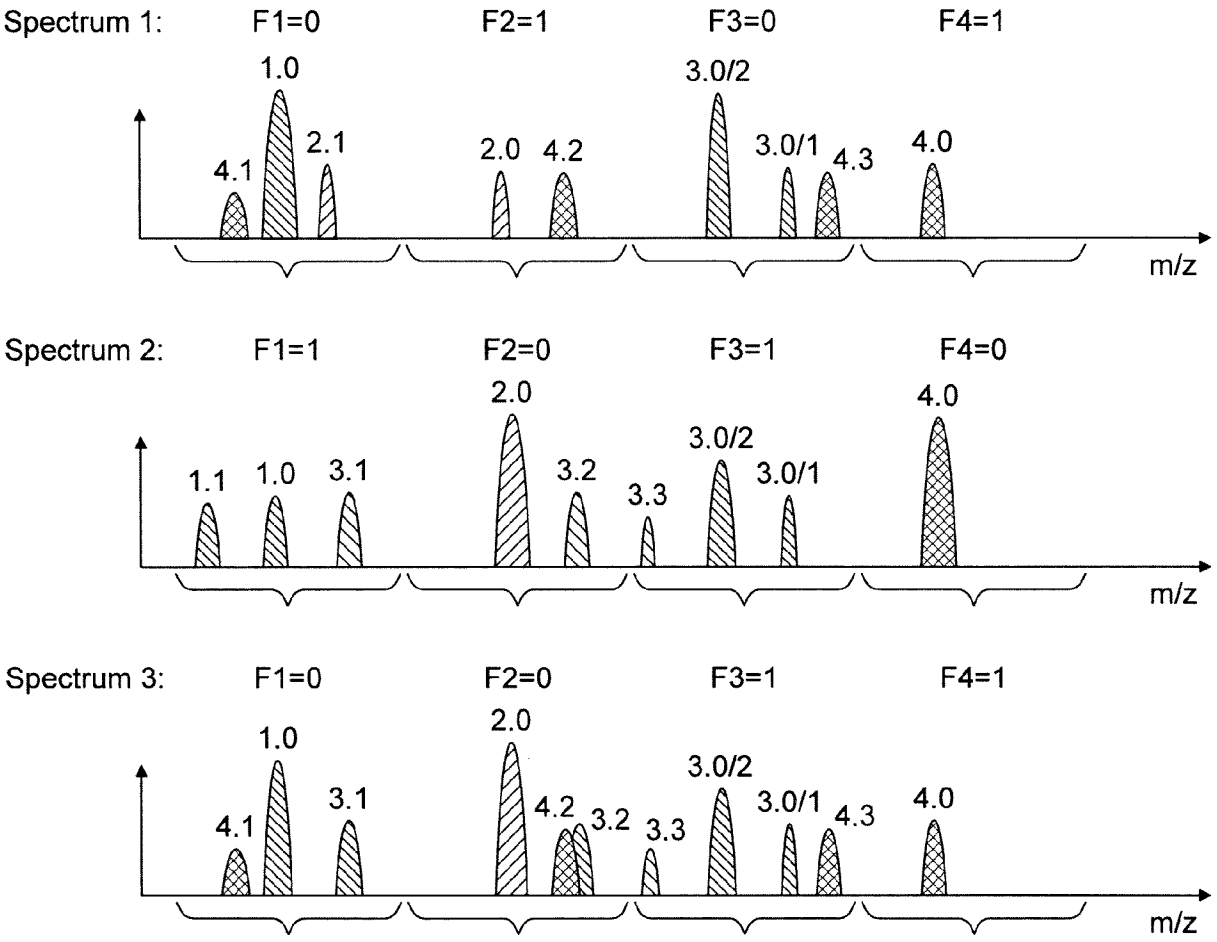
FIG. 9 shows a simplified example of three separate spectra each derived across the same relatively broad mass range, but using different segment fragmentation protocols for deconvolution of peaks.

Having described in detail a preferred embodiment of a method, and a range of apparatuses which can be employed to implement that method, a specific example of the method will now be described, with reference to FIGS. 9 and 10, in order further to explain the manner in which the results may be analyzed to permit deconvolution of spectra. Referring first to FIG. 9, three spectra, labelled spectrum 1, spectrum 2 and spectrum 3, are shown one above the other. Each of the spectra constitutes one of the N scan cycles of steps 610 and 620 of FIG. 6: that is N=3. For the sake of simplicity of explanation, each spectrum is comprised of four segments, that is, L=4, and, in each case, the total mass range $[M_P \ldots M_Q]$ is the same. Across that mass range, the spectra of FIG. 8 have five precursors.

In FIG. 9, the precursors from each segment i are labelled using the same shading pattern (crosshatch, etc) as their fragments. Precursors are also given the index (i,0) whilst their fragments have indices (i,j) with j increasing with m/z. FIG. 9 also lists the flag $F_i$ for each $i^{th}$ segment, for each spectrum. It will be noted that the flag patterns for each spectrum differ (since, of course, each spectrum in FIG. 9 would be expected to be essentially identical if the flag pattern were the same for each). It is advantageous if each spectrum has a similar number of precursors and fragments (although differently distributed in m/z and intensities), thus avoiding overcrowding of spectra as observed with the $MS^e$ method.

Inspecting FIG. 9, the skilled reader will recognise that any precursor within a given segment which is not subjected to fragmentation will remain apparent in that segment (and that segment only). For example, in spectrum 2, a large peak (only) in segment 4 is seen for precursor (4,0) since no fragmentation (flag F4=0) is applied to that segment.

For each $j^{th}$ mass peak in each $i^{th}$ segment $M_{i,j}$ the dependence of signal intensity on scan cycle number $I_{i,j}(n)$ is built. Decoding is then achieved by applying logic rules to the obtained data. The process thus involves searching for correlation of this dependence $I_{i,j}(n)$ with scan dependencies for other mass peaks in all of the segments which have been subjected to fragmentation, and which, moreover, are theoretically capable of producing such a peak. For example, the software may apply rules in the search such as that the fragment cannot have a higher mass than a precursor mass (when the latter is recalculated to a single charge), that the intensity of any fragment cannot be higher than the intensity of the precursor from which it derives, that certain fragments are used as characteristic for a particular precursor (e.g. complimentary pairs where masses of two fragments add up to the accurate precursor mass), etc. Additional information about the sample and rules of fragmentation such as, but not limited to, relations between precursor and fragment masses, possible fragmentation pathways, ion mobilities and reactivities can also be employed in analysis of the data.

Figure 10:
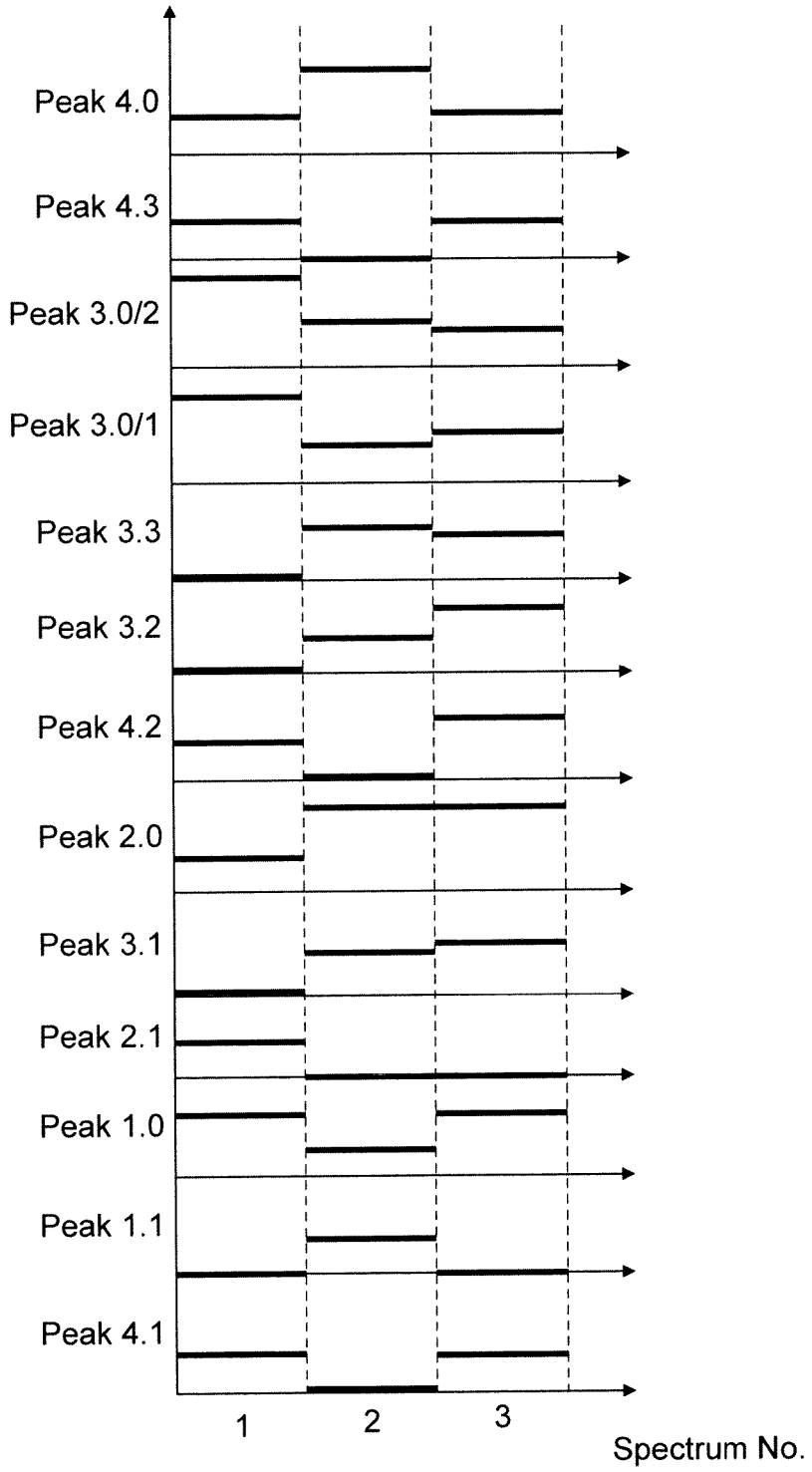
FIG. 10 shows the resulting dependence of ion intensities on scan number, to illustrate the relative abundances using different fragmentation protocols for different segments over multiple cycles.

FIG. 10 shows the resulting dependence of intensities on spectrum (scan cycle) number for the specific spectra of FIG. 9. It will be noted that the spectra for segments i=1, 2 and 4 can be easily deconvolved, except for the peak (4,2) which overlaps with (3,2), because there is only one precursor peak per segment.

The spectra for i=3 can, however, only be deconvolved using additional time dependence of the peaks with the same fragmentation flag F. For example, the peak (3,1) can be seen to grow together with the precursor (3,0/1), whilst the peak (3,3) reduces together with the precursor (3,0/2). The overlapping peak (3,2)/(4,2) changes in a different way to any of the precursors and hence it may be concluded that this represents an interference of two peaks. In turn, it may be resolved by obtaining further spectra (or unexplained, non-correlating fragments can instead be excluded from further analysis).

Implementation of the method described above in respect of the embodiments of FIGS. 1 to 3 provides a duty cycle of 1/L on average. For the embodiments of FIGS. 4, 5A, 5B, 7*a*.7*b*.8*a* and 8*b*, the duty cycle may exceed 50%. Therefore, for these latter embodiments, all data may be acquired all the time and the variety of possible modulation methods may be greatly extended. For example, segment 3 in FIG. 9 may be split in a data-dependent manner into 2 sub segments, with a number of ions $K_i$ variable in time in different ways for each of the sub segments.

It should be noted that the minimum number of scans N is one because even a single scan with several segments could yield analytically useful information (and possibly better than two one-segment scans at different degrees of fragmentation). For example, neutral loss information could be obtained for a segment with a higher degree of fragmentation, whilst accurate mass information and intensity for the precursor could be obtained from another segment, where the latter is present with a different charge state. Another example is targeted analysis, where only segments containing targeted compound are subjected to a higher degree of fragmentation. As other compounds (especially high-abundance matrix peaks) are not subjected to fragmentation, the spectrum remains uncrowded. This in turn allows known fragments to be identified with a better signal-to-noise ratio. These can be used for confirmation of the identity of the precursor. Meanwhile, knowledge of fragmentation conditions as well as the ratios between the precursor and fragment intensities allows the original intensity of the precursor to be deconvoluted, so that, in consequence, quantitative analysis can be provided.

Although a number of embodiments have been described, it will be understood that these are by way of illustration only and that further alternative arrangements may be contemplated.

The invention claimed is:

1. A method of tandem mass spectrometry, comprising, for an $n^{th}$ scan cycle:

(a) generating ions in an ion source;

(b) selecting a range of mass to charge ratios $[M_P \ldots M_Q]$, $M_P<M_Q$, from the ions generated by the ion source;

(c) subdividing the range $[M_P \ldots M_Q]$ into a plurality L of segments (L>1), each $i^{th}$ segment comprising ions across a range of mass to charge ratios $(m_i \ldots m_i+\Delta m_i)$ forming a subset of the range $M_P \ldots M_Q$;

(d) subjecting ions within at least a first one, $L_i$, of the L segments to a first, relatively lower degree of fragmentation $F_i$ ($F_i$>=0), while subjecting ions within at least a second one, $L_j$, of the L segments to a second, relatively higher degree of fragmentation $F_j$ ($F_j>F_i$), such that at least some of the precursor ions in the second segment $L_j$ are caused to fragment; and (e) accumulating the precursor and fragment ions from the plurality of segments in a ion trapping device, ejecting a mixture of precursor and fragment ions from the ion trapping device into a mass analyzer, and mass analyzing the precursor and fragment ions from the plurality of segments together in the $n^{th}$ scan cycle so as to capture a composite mass spectrum for the precursor and fragment ions for the mass range $[M_P \ldots M_Q]$.

2. The method of claim 1, further comprising repeating steps (a) to (e) in a subsequent $(n+1)^{th}$ cycle, wherein, in that subsequent $(n+1)^{th}$ cycle, one or more of the following parameters is different from that employed in the $n^{th}$ cycle:

(i) the selected mass range $[M_P \ldots M_Q]$;

(ii) the number, L', of segments into which the selected mass range is subdivided;

(iii) the mass range of one or more of the L' segments into which the selected mass range is subdivided;

(iv) the number of ions in one or more of the L' segments;

(v) the particular segment(s) $L'_i$ whose ions are subjected to the first, relatively low degree of fragmentation, and/or the particular segment(s) $L'_j$ whose ions are subjected to the second, relatively high degree of fragmentation; and (vi) the resolving power of mass analysis.

3. The method of claim 2, wherein the total number of precursor and fragment ions which are mass analyzed are substantially the same in the $n^{th}$ and $(n+1)^{th}$ cycles, while the m/z and intensity distributions of each differ as between the different cycles.

4. The method of claim 1, wherein the step (d) of subjecting ions in at least a second one $L_j$ of the segments to a relatively higher degree of fragmentation $F_j$ comprises directing ions within that segment to a fragmentation cell.

5. The method of claim 4, wherein the step (d) of subjecting the ions in the at least first one $L_i$ of the segments to a relatively lower degree of fragmentation $F_i$ comprises directing ions within that first segment $L_i$ to the same fragmentation cell to which the ions of the second segment $L_j$ are directed, at a different time, and wherein a voltage $V_i$ is applied to the fragmentation cell in respect of the first segment $L_i$, wherein a voltage $V_j$ is applied to the fragmentation cell in respect of the second segment $L_j$, and wherein $V_i$ is lower than $V_j$, such that fewer precursor ions, are then fragmented.

6. The method of claim 5, further comprising switching between $V_i$ and $V_j$ as the first and second segments $L_i$, $L_j$ are directed to the fragmentation cell respectively; and preventing ions from entering the fragmentation cell during a switching time $t_{switch}$ as $V_i$ changes to $V_j$ or $V_j$ changes to $V_i$.

7. The method of claim 1, wherein ions in a plurality of segments $L_A$ are each subjected to a respective different fragmentation energy $E_A$ ($A \geq 3$; $E_A \neq E_i, E_j$).

8. The method of claim 4, wherein the step (d) of subjecting ions in the at least first one $L_i$ of the segments to a relatively lower degree of fragmentation comprises directing those ions in that or those segment(s) $L_i$ to bypass the fragmentation cell so that they are mass analyzed as the said precursor ions.

9. The method of claim 1, wherein the step (c) of subdividing the range $M_P \ldots M_Q$ into a plurality of L segments comprises directing the ions from the ion source into a mass filter or mass dispersing device in time and/or space, and setting the parameters of the mass filter or mass dispersing device so as to control the ion population for at least some of the L segments.

10. The method of claim 9, further comprising setting at least one of the following parameters: the transmission time $t_i$ of the mass filter, the transmitted mass range $m_i \ldots m_i+\Delta m_i$ of the mass filter, and the fragmentation energy, so as to control the total number $K_i$ of ions to be analyzed and/or the degree of fragmentation in a given segment $L_i$.

11. The method of claim 10, further comprising carrying out a pre-scan mass analysis of an analyze; and setting the parameters based upon the results of the pre-scan mass analysis.

12. The method of claim 9, wherein the number of ions $K_i$ within at least some of the segments is controlled by directing ions within that or those segment(s) towards a gating means, and operating that gating means so as to permit passage of only a subset of the incident ions in that or those segments.

13. The method of claim 1, further comprising mixing the precursor and fragment ions from two or more of the L segments prior to mass analysis of the mixture.

14. The method of claim 13, further comprising mixing the precursor and fragment ions from each of the L segments prior to an all mass analysis of ions from across the mass range $[M_P \ldots M_Q]$.

15. The method of claim 1, wherein the step of mass analyzing comprises directing precursor and fragment ions to one or more of an orbital trap, FT-ICR or TOF mass analyzer.

16. The method of claim 2, further comprising:

the step of processing the mass analysis data obtained from the $n^{th}$ and $(n+1)^{th}$ scan cycles so as to permit identification of mass peaks.

17. The method of claim 16, wherein the step of processing the mass analysis data from multiple cycles comprises applying one or more logic constraints to the mass analysis data as it is processed.

18. The method of claim 1, wherein the step of subjecting ions to a relatively higher fragmentation energy includes fragmenting the ions by one or other of: electron transfer dissociation (ETD); electron capture dissociation (ECD); electron ionisation dissociation (EID); ozone induced dissociation (OzID); IRMPD; UV dissociation.

19. The method of claim 1, further comprising the steps:

(f) repeating steps (a) to (e) in at least one subsequent cycle but differing in terms of the particular segment(s) $L'_i$ that are subjected to the first, relatively low degree of fragmentation, and in terms of the particular segment(s) $L'_j$ that are subjected to the second, relatively high degree of fragmentation;

(g) for each $j^{th}$ mass peak in each $i^{th}$ segment, determining a dependence of signal intensity on scan cycle number $I_{i,j}(n)$;

(h) determining correlations between $I_{i,j}(n)$ and the dependence of signal intensity on scan cycle number for other mass peaks in other segments;

identifying from said correlations a precursor ion associated with the $j^{th}$ mass peak.

20. A tandem mass spectrometer comprising:

(a) an ion source for generating ions from an analyze;

(b) a mass filter or mass-dispersing device arranged to receive ions generated by the ion source and to transmit a subset of those received ions;

(c) a fragmentation cell configured to receive ions from the mass filter or mass dispersing device;

(d) a mass analyzer for analyzing the output of the fragmentation cell; and (e) an ion trapping device for accumulating ions;

(f) a controller configured for an $n^{th}$ scan cycle:

(i) to control the mass filter or mass dispersing device so as to cause it to select a plurality L (L>1) of mass to charge range segments each subdivided from a relatively broader range of mass to charge ratios $[M_P \ldots M_Q]M_P<M_Q$ from the ions generated by the ion source, wherein each $i^{th}$ segment comprises ions across a range of mass to charge ratios ($m_i \ldots m_i+\Delta m_i$) forming a subset of the relatively broader range $M_P \ldots M_Q$;

(ii) to control the fragmentation cell so that ions within at least a first one $L_i$ of the L segments are caused to be subjected to a first, relatively low degree of fragmentation $F_i(F_i>0)$, while ions within at least a second one $L_j$ of the L segments are caused to be subjected to a second, relatively higher degree of fragmentation $F_j$ ($F_j>F_i$), such that at least some of the precursor ions in the second segment $L_j$ are caused to fragment;

(iii) to control the ion trapping device so the precursor and fragment ions from the at least first one $L_j$ and the at least second one $L_j$ of the L segments together in the ion trapping device and eject the mixture of precursor and fragment ions into the mass analyzer, (iv) to control the mass analyzer to analyze the precursor and fragment ions from the from the at least first one $L_j$ and the at least second one $L_j$ of the segments together; and (v) to generate a composite mass spectrum for both precursor and fragment ions from the mass range $M_P \ldots M_Q$for that $n^{th}$ scan cycle.

21. The spectrometer of claim 20, wherein the controller is further configured to control the spectrometer so as to cause it to store ions from each segment $L_j$; $L_j$ together in the fragmentation cell.

22. The spectrometer of claim 20, wherein the mass analyzer is one or more of an orbital trap, an electrostatic trap, an FT-ICR or a TOF mass analyzer.

23. The spectrometer of claim 20, wherein the fragmentation cell is an RF only collision cell.

24. The spectrometer of claim 23, arranged to carry out fragmentation in accordance with one or other of the following techniques:

(a) electron transfer dissociation (ETD);
(b) electron capture dissociation (ECD);
(c) electron ionisation dissociation (EID);
(d) ozone induced dissociation (OzID);
(e) IRMPD; and
(f) UV dissociation.

25. The spectrometer of claim 23, wherein the fragmentation cell is arranged in line between the mass filter or mass dispersing device and the mass analyzer.

26. The spectrometer of claim 23, wherein the fragmentation cell is positioned in a "dead end" configuration out of an ion path from the mass filter or mass dispersing device, via an ion storage device to the mass analyzer.

27. The spectrometer of claim 20, wherein the mass filter or mass dispersing device is a quadrupole mass filter, quadrupole ion trap (3D trap) or a linear ion trap (LT) or a TOF mass filter.

28. The spectrometer of claim 20, further comprising an ion gate, the controller being further configured to control the gate so that the number of ions coming into the fragmentation cell in at least some of the segments is limited.

29. The spectrometer of claim 28, wherein the controller is configured to operate the ion gate synchronously with a change in parameters of ion fragmentation within the fragmentation cell including a voltage offset of the cell, and/or electron/photon/ion/reactant flux into the cell.

* * * * *